US008918035B2

(12) United States Patent
Hasegawa et al.

(10) Patent No.: US 8,918,035 B2
(45) Date of Patent: Dec. 23, 2014

(54) DEVELOPING APPARATUS, DEVELOPING METHOD AND MAGNETIC TONER FOR DEVELOPING APPARATUS

(71) Applicant: Canon Kabushiki Kaisha, Tokyo (JP)

(72) Inventors: Yusuke Hasegawa, Suntou-gun (JP); Yoshitaka Suzumura, Mishima (JP); Kozue Uratani, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 175 days.

(21) Appl. No.: 13/725,202

(22) Filed: Dec. 21, 2012

(65) Prior Publication Data

US 2013/0164044 A1 Jun. 27, 2013

(30) Foreign Application Priority Data

Dec. 27, 2011 (JP) ..... 2011-286203

(51) Int. Cl.
*G03G 15/09* (2006.01)
*G03G 15/08* (2006.01)

(52) U.S. Cl.
CPC ..... *G03G 15/0839* (2013.01); *G03G 15/09* (2013.01); *G03G 15/0812* (2013.01)
USPC ..... 399/274; 430/123.56

(58) Field of Classification Search
CPC .. G03G 13/08; G03G 15/081; G03G 15/0839
USPC ..... 399/274; 430/123.56
See application file for complete search history.

(56) References Cited

U.S. PATENT DOCUMENTS 5,175,586 A 12/1992 Goseki et al.
5,666,626 A * 9/1997 Takizawa et al. ..... 399/286
6,586,151 B1 7/2003 Naka et al.
6,703,176 B2 3/2004 Naka et al.
6,803,164 B2 10/2004 Mizoo et al.
6,953,646 B2 10/2005 Doujo et al.
7,016,633 B2 3/2006 Ishigaki (Continued)

FOREIGN PATENT DOCUMENTS

CN 1065144 A 10/1992
CN 1452028 A 10/2003
JP 2004-4751 A 1/2004
JP 2007-79118 A 3/2007

OTHER PUBLICATIONS

Chinese Office Action dated Jun. 26, 2014 in Chinese Application No. 201210581571.X.

(Continued)

*Primary Examiner* — David Gray
*Assistant Examiner* — Michael Harrison
(74) *Attorney, Agent, or Firm* — Fitzpatrick, Cella, Harper and Scinto

(57) ABSTRACT

An object of the present invention is to provide a developing apparatus which can provide images having superior image density and less fogging.

The present invention relates to a developing apparatus wherein a magnetic toner-carrying member has a work function value at the surface within a specific range, a toner regulating member which regulates toner carried on the magnetic toner-carrying member is formed by a specific material at a portion contacting the magnetic toner, and has a ratio [W/B] of the amount W of silica fine powder to the theoretical specific surface area B of the magnetic toner satisfying a specific relation.

5 Claims, 3 Drawing Sheets

(56) References Cited

U.S. PATENT DOCUMENTS

| | | | | |
|---|---|---|---|---|
| 7,123,862 | B2 | 10/2006 | Hasegawa et al. | |
| 7,160,660 | B2 | 1/2007 | Dojo et al. | |
| 7,368,211 | B2 | 5/2008 | Hasegawa et al. | |
| 7,470,494 | B2 | 12/2008 | Nishiyama et al. | |
| 7,582,401 | B2 | 9/2009 | Ogawa et al. | |
| 7,678,524 | B2 | 3/2010 | Hasegawa et al. | |
| 7,704,659 | B2 | 4/2010 | Ogawa et al. | |
| 7,811,734 | B2 | 10/2010 | Ogawa et al. | |
| 7,939,231 | B2 | 5/2011 | Ogawa et al. | |
| 8,084,174 | B2 | 12/2011 | Hasegawa et al. | |
| 8,124,306 | B2 | 2/2012 | Hirata et al. | |
| 8,227,162 | B2 | 7/2012 | Sano et al. | |
| 8,377,616 | B2 | 2/2013 | Tani et al. | |
| 2002/0127033 | A1* | 9/2002 | Inoue et al. | 399/279 |
| 2003/0108364 | A1* | 6/2003 | Do | 399/284 |
| 2003/0194250 | A1 | 10/2003 | Ishigaki | |
| 2005/0111885 | A1 | 5/2005 | Ishigaki | |
| 2011/0294056 | A1 | 12/2011 | Magome et al. | |
| 2011/0311910 | A1 | 12/2011 | Matsui et al. | |
| 2012/0231384 | A1 | 9/2012 | Aoki et al. | |
| 2012/0231388 | A1 | 9/2012 | Kawamura et al. | |
| 2012/0315060 | A1* | 12/2012 | Sugiyama et al. | 399/69 |

OTHER PUBLICATIONS

Matsui, et al., U.S. Appl. No. 13/817,782, 371(c) Date: Feb. 19, 2013.
Tanaka, et al., U.S. Appl. No. 13/646,384, filed Oct. 5, 2012.

* cited by examiner

DEVELOPING APPARATUS, DEVELOPING METHOD AND MAGNETIC TONER FOR DEVELOPING APPARATUS

BACKGROUND OF THE INVENTION

1. Field of the Invention

The present invention relates to a developing apparatus, a developing method and magnetic toner which are used for an image-forming method for visualizing electrostatic images in electrophotography.

2. Description of the Related Art

Image-forming apparatuses such as copiers and printers recently have varied usage purposes and environments as well as being required to be even faster, provide higher image quality and have higher stability. For example, printers which have conventionally been mainly used in offices are now used in harsh environments and thus it is important for the printers to provide stabilized images under such conditions. Known developing apparatuses used for such image-forming apparatuses generally comprise the configuration in which a blade made of rubber or metal acting as a toner layer thickness regulating member for regulating the toner coat amount is brought into contact with the surface of a developing sleeve acting as a developer (toner)-carrying member.

Toner is provided with positive or negative charge by friction between the regulating member and toner and/or friction between the toner-carrying member and toner. The charged toner is thinly applied on the surface of the toner-carrying member by the regulating member. It is a general developing method in which the charged toner is allowed to fly and adhere to an electrostatic latent image on the surface of an electrostatic latent image bearing member opposing to the toner-carrying member.

It is recently required that the image-forming apparatus technology is directed to provide high fineness, high quality and high image quality as well as high speed and high reliability for a long term use. On the other hand, in terms of energy saving, it is also required to provide better fixing performance at lower temperatures. Under such circumstances, depending on the type of materials of regulating members, usage environments or image printing conditions such as process speed, toner may be melt-adhered on various members in developing apparatuses, resulting in image defects such as image density non-uniformity or streaks.

When, in a high-temperature, high-humidity environment which is particularly disadvantageous for rising of charging toner, continuous image printing is carried out for a long term, some magnetic toner in the developing apparatus which has faster rising of charging may be sometimes consumed preferentially, namely, so-called selective development may occur. As a result, when the developing apparatus is used again for image printing after it has been left to stand during the latter half of the usage, images may be deteriorated by, for example, low density and fogging.

On the other hand, various trials for improving regulating members and toner-carrying members have been carried out. Japanese Patent Application Laid-open No. 2004-4751 discloses the hardness and deformation rate on the surface of a developer bearing member and a developing apparatus in which the ten point mean roughness (Rz) of the surface which contacts the developer bearing member of a developer amount regulating blade is 0.3 to 20 μm. In this patent document, non-magnetic black toner is evaluated on the developing apparatus and exhibits effects on solid image density, unevenness and streaks in each environment. On the other hand, stability in a long term durability test has not been sufficiently evaluated, and in particular, when monocomponent magnetic toner is used, the effects tend to be insufficient.

Japanese Patent Application Laid-open No. 2007-79118 discloses a trial for improving toner melt adhesion and thin line reproducibility by using a specific toner regulating blade to define the adhesion strength between the toner regulating blade and toner. However, in this document, material of the blade or the amount of an external additive(s) is not sufficiently optimized, so that there is room for improvement in terms of low density or fogging which particularly occurs after a long term durability test.

Therefore, there has been a need for a developing apparatus comprising monocomponent magnetic toner which is stable in a long term durability test and can provide preferable images with superior image density and less fogging even when it is left to stand after a long term durability test.

SUMMARY OF THE INVENTION

The present invention is to provide a developing apparatus in which the above problems are solved.

Namely, the present invention is to provide a developing apparatus, a developing method and magnetic toner used for the developing apparatus which have high process speed, use a large-capacity process cartridge, prevent selective development when it is used in a high-temperature, high-humidity environment and can provide images with superior image density and less fogging even when it is left to stand during the latter half of usage.

Further, the present invention similarly provides a developing apparatus and a developing method which have high process speed, use a large-capacity process cartridge and can prevent melt adhesion of magnetic toner on a magnetic toner-carrying member or a regulating member even when it is used in a high-temperature, high-humidity condition to provide preferable images without image density non-uniformity or streaks for a long term.

The present inventors have found out that the above problems can be solved by adjusting the work function value of the surface of a magnetic toner-carrying member within a specific range, using a specific toner regulating member and controlling the amount of silica fine powder contained in magnetic toner, thereby completing the present invention.

Thus, the present invention is described as follows:

a developing apparatus comprising an electrostatic latent image bearing member on which an electrostatic latent image is formed, magnetic toner for developing the electrostatic latent image, a magnetic toner-carrying member, arranged so as to oppose the electrostatic latent image bearing member, for carrying and transporting the magnetic toner, and a toner regulating member contacting the magnetic toner-carrying member and regulating the magnetic toner carried on the magnetic toner-carrying member, wherein:

the magnetic toner-carrying member has a work function value at the surface of 4.6 eV or more and 4.9 eV or less, a portion of the toner regulating member, which is contacting the magnetic toner, is made of a polyphenylene sulfide or a polyolefin, and the magnetic toner i) comprises magnetic toner particles, each of which contains a binder resin and magnetic powder, and silica fine powder, ii) has negative charging property, iii) has a ratio [W/B] of an amount W (mass % relative to the magnetic toner) of the silica fine powder to a theoretical specific surface area B ($m^2/g$) of the magnetic toner determined from particle diameter distribution (number statistical value) satisfying the following formula (1):

$$2.5 \leq W/B \leq 10.0. \quad (1)$$

Further features of the present invention will become apparent from the following description of exemplary embodiments (with reference to the attached drawings).

BRIEF DESCRIPTION OF THE DRAWINGS

Further features of the present invention will become apparent from the following description of exemplary embodiments with reference to the attached drawings.

DESCRIPTION OF THE EMBODIMENTS

The present invention will be described in detail hereinbelow.

Thus, the developing apparatus of the present invention is a developing apparatus comprising an electrostatic latent image bearing member on which an electrostatic latent image is formed, magnetic toner for developing the electrostatic latent image, a magnetic toner-carrying member arranged so as to oppose the electrostatic latent image bearing member for carrying and transporting the magnetic toner, and a toner regulating member contacting the magnetic toner-carrying member and regulating the magnetic toner carried on the magnetic toner-carrying member, wherein:

the magnetic toner-carrying member has a work function value at the surface of 4.6 eV or more and 4.9 eV or less, a portion of the toner regulating member, which is contacting the magnetic toner, is made of a polyphenylene sulfide or a polyolefin, and the magnetic toner i) comprises magnetic toner particles, each of which contains a binder resin and magnetic powder, and silica fine powder, ii) has negative charging property, iii) has a ratio [W/B] of an amount W (mass % relative to the magnetic toner) of the silica fine powder to a theoretical specific surface area B ($m^2/g$) of the magnetic toner determined from particle diameter distribution (number statistical value) satisfying the following formula (1):

$$2.5 \leq W/B \leq 10.0. \quad (1)$$

Generally in magnetic monocomponent development, magnetic toner is transported by a magnetic toner-carrying member and a toner regulating member (hereinafter also merely referred to as a regulating member) regulates the thickness of a magnetic toner coat layer. Under this situation, magnetic toner behaves as follows at a portion (hereinafter referred to as a regulating portion) where the magnetic toner-carrying member contacts the regulating member.

Figure 1:
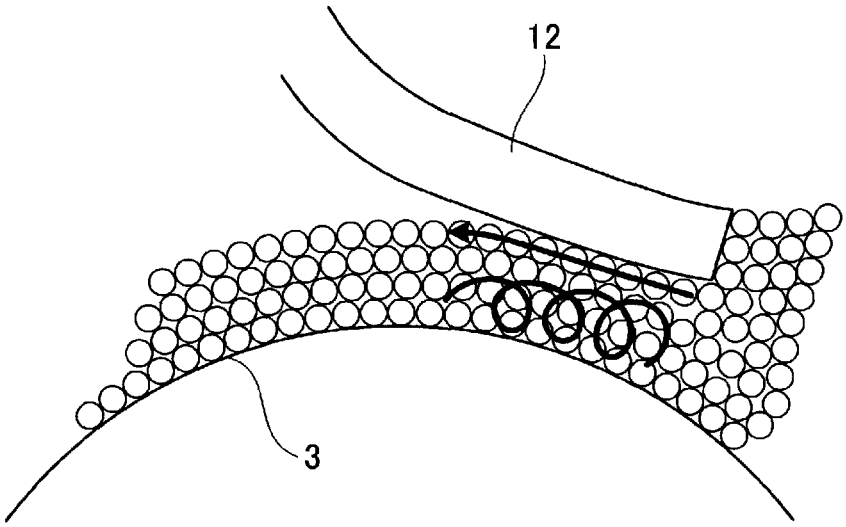
FIG. 1 is a diagram that shows behavior of toner around a magnetic toner-carrying member and a regulating member of a developing apparatus.

The magnetic toner in the vicinity of the surface of the magnetic toner-carrying member is transported while being substituted so as to be agitated due to the rotating force of the magnetic toner-carrying member and the pressing pressure from the regulating member which are applied to the regulating portion as well as an influence by the irregularity of the magnetic toner-carrying member (see FIG. 1). The magnetic toner is charged mainly due to the contact thereof with the magnetic toner-carrying member.

On the other hand, magnetic toner in the vicinity of the magnetic toner regulating member is relatively distant from the surface irregularity of the magnetic toner-carrying member, so that it is difficult to be agitated. In addition, as the regulating member of magnetic toner and the magnetic toner generally have positive charging property and negative charging property, respectively, electrostatic force may be generated between the toner regulating member and the magnetic toner. Due to this, the magnetic toner is less mobile and less substituted in the vicinity of the toner regulating member. Because of this, magnetic toner in the vicinity of the regulating member is excessively charged, resulting in non-uniform distribution of the charge amount of the magnetic toner.

In order to increase the charge amount of magnetic toner, it is a general practice to increase the contact pressure of the regulating member or use a material having higher positive charging property for the regulating member. However, these means may further limit the mobility of magnetic toner and may significantly result in excess charging of some of magnetic toner as described above.

In such a case, depending on the material of the regulating member or image printing conditions such as image printing environments, some magnetic toner in the developing apparatus which has faster rising of charging may be sometimes consumed preferentially, namely, so-called selective development may occur. As a result, when the developing apparatus is used again for image printing after it has been left to stand during the latter half of the usage, images may be deteriorated by, for example, low image density and fogging.

In addition, magnetic toner may be melt-adhered on the magnetic toner-carrying member or regulating member to cause image density non-uniformity and particularly when the level of toner melt adhesion is not appropriate, image quality may be deteriorated such as by causing streaks and the like. The present inventors believe that the reason for this is as follows.

As described above, when magnetic toner is less mobile in the vicinity of the regulating member and the magnetic toner-carrying member to form an immobile layer, magnetic toner in the vicinity of the regulating member and the magnetic toner-carrying member may be excessively charged. As a result, the excessively charged magnetic toner may originate electrostatic cohesion with less-charged magnetic toner by means of electrostatic attractive force and thus may form relatively thick and high magnetic spikes of magnetic toner on the magnetic toner-carrying member.

The thick and high magnetic spikes cause uneven contact with the regulating member and the magnetic toner-carrying member compared to other magnetic spikes of magnetic toner, thereby further promoting non-uniform charging of magnetic toner. Accordingly, selective development tends to occur in which magnetic toner having faster rising of charging is preferentially consumed in development.

Particularly in a high-temperature, high-humidity environment which is disadvantageous for rising of charging, charge amount distribution of magnetic toner tends to be non-uniform and magnetic toner in the developing apparatus which has slower rising of charging such as magnetic toner having relatively large particle diameter tends to accumulate in the developing apparatus.

When, under such situation, printing is stopped and image printing is again performed after the apparatus is left to stand for a long time and charging is lessened, magnetic toner is less substituted at the regulating portion as well as is inhibited from effective charging, thereby frequently deteriorating image quality such as by causing low image density and fogging.

In a developing apparatus having high process speed, the above problems may be particularly significant because magnetic toner travels the regulating portion between the magnetic toner-carrying member and the regulating member in a short time which is disadvantage for rising of charging and magnetic toner is less substituted.

Similarly in a developing apparatus having high process speed, magnetic toner accumulates in the vicinity of the regulating member as described above, and therefore shear force may be concentrated on the magnetic toner and the magnetic toner is melt-adhered on the regulating member or the magnetic toner-carrying member. Thus image quality may be frequently deteriorated with image density non-uniformity and streaks.

When a large-capacity process cartridge is used, magnetic toner is pressed onto the magnetic toner-carrying member because of own weight of magnetic toner in the developing apparatus, which may further make formation of magnetic spikes unstable and may easily cause melt adhesion of toner onto the magnetic toner-carrying member.

Recent miniaturization of image-forming apparatuses is accompanied by decrease in the diameter of the magnetic toner-carrying member. Therefore the developing zone becomes smaller due to the curvature of the magnetic toner-carrying member itself, and therefore magnetic toner may be difficult to fly from the magnetic toner-carrying member. This also promotes the selective development, worsening the above problems.

As a result of extensive studies carried out by the present inventors, they have found that the above problems can be solved by using polyphenylene sulfides or polyolefins as the regulating member of the magnetic toner, adjusting the work function value at the surface of the magnetic toner-carrying member to 4.6 eV or more and 4.9 eV or less and using a specific magnetic toner. Particularly, they think that it is important to control the magnetic spikes small, thin and uniform by the above configurations.

In order to control the magnetic spikes of magnetic toner on the magnetic toner-carrying member small, thin and uniform, it is effective to improve substitution of magnetic toner at the regulating portion so that the immobile layer of the magnetic toner in the vicinity of the regulating member and the magnetic toner-carrying member is as low as possible.

If magnetic toner is accumulated in the vicinity of the regulating member, it tends to form the immobile layer in the vicinity of the regulating member because it is distant from surface irregularity of the magnetic toner-carrying member which is mainly involved in transportation of magnetic toner by the regulating portion.

Accordingly, the present inventors thought to improve substitution of magnetic toner at the regulating portion by decreasing electrostatic adhesion strength between the regulating member and magnetic toner.

Namely, as the regulating member, they employed polyphenylene sulfides or polyolefins rather than general silicon rubbers, polyurethanes, polycarbonates and the like having positive charging property compared to magnetic toner. Polyphenylene sulfides and polyolefins have almost the same potential or weakly negative charging property compared to magnetic toner, so that the magnetic toner in the vicinity of the regulating member is seldom charged. Due to this, it is believed that electrostatic adhesion strength between the regulating member and magnetic toner can be significantly decreased and, as a result, substitution of magnetic toner at the regulating portion can be significantly improved.

On the other hand, as the regulating member made of polyphenylene sulfides or polyolefins is seldom involved in charging, it is important that the magnetic toner-carrying member has the work function value at the surface of 4.6 eV or more and 4.9 eV or less in order to effectively charge magnetic toner.

The work function value is generally indicative of liability to release free electrons with the lower value meaning higher liability to release free electrons. The surface of the magnetic toner-carrying member having lower work function value allows easier charging of the magnetic toner because free electrons are more easily exchanged when it is brought into contact and rubbed with the magnetic toner. Therefore, it is important that the magnetic toner-carrying member has the work function value at the surface of 4.9 eV or less.

Here, it is not preferable that the magnetic toner-carrying member has the work function value at the surface of more than 4.9 eV because it is difficult to appropriately exchange free electrons between the surface of the magnetic toner-carrying member and magnetic toner, resulting in reduction in the charge amount of the toner.

On the other hand, it is not preferable that the magnetic toner-carrying member has the work function value at the surface of less than 4.6 eV, the charge amount of the magnetic toner is excessive, thereby increasing the electrostatic adhesion strength. As a result, the magnetic toner on the magnetic toner-carrying member becomes less mobile, broadening the distribution of the charge amount.

Namely, by employing any of polyphenylene sulfides and polyolefins as the regulating member, magnetic toner in the vicinity of the regulating member is more mobile. As a result, magnetic toner can contact the surface of the magnetic toner-carrying member having a specific work function value with greater frequency, thereby being effectively charged.

In the present invention, adjustment of the work function value at the surface of the magnetic toner-carrying member may be suitably exemplified by inclusion of conductive particles described below in a resin layer forming a surface layer of the magnetic toner-carrying member. The conductive particles may include fine powder of metal (aluminum, copper, nickel, silver and the like), particles of conductive metal oxides (antimony oxide, indium oxide, tin oxide, titanium oxide, zinc oxide, molybdenum oxide, potassium titanate and the like), crystalline graphite, carbon fibers, conductive carbon black and the like.

In the present invention, the type of these conductive particles and the amount thereof may be appropriately selected in order to adjust the work function value at the surface of the magnetic toner-carrying member.

The work function value can be decreased by, for example, adding conductive particles having low work function values such as aluminum, copper, silver, nickel and the like metal powder or graphite at a high amount. It is also possible to increase the work function value by adding oxidized carbon black or decreasing the amount of the conductive particles per se.

Carbon black can be oxidized by known techniques which can be exemplified by, for example, surface oxidization with ozone and the like, oxidization with potassium permanganate and the like. By oxidizing the surface of carbon black according to such a technique, the surface of carbon black is provided with surface functional groups such as carboxyl and sulfonate groups that can increase the work function value.

However, solely the above configurations are still insufficient in order to control the magnetic spikes small, thin and uniform, when magnetic toner is applied for a developing apparatus with high process speed in which magnetic toner travels the regulating portion between the magnetic toner-carrying member and the regulating member in a short time or a large-capacity process cartridge is used.

The present invention is characterized in that the magnetic toner particles are further externally added with silica fine powder and has a ratio [W/B] of an amount W (mass % relative to the magnetic toner) of the silica fine powder to a theoretical specific surface area B ($m^2/g$) determined from particle diameter distribution of the magnetic toner satisfyingthe following formula (1):

$$2.5 \leq W/B \leq 10.0. \quad (1)$$

The above [W/B] preferably satisfies 3.0 W/B 5.0. By adjusting the ratio of the amount W of the silica fine powder relative to the theoretical specific surface area B ($m^2/g$) determined from particle diameter distribution of the magnetic toner to the above range, relatively high amount of silica fine powder exists on the surface of the magnetic toner particles. As a result, van der Waals forces and electrostatic adhesion strength between magnetic toner particles or between magnetic toner and members can be significantly decreased due to a spacer effect.

Accordingly, particularly when polyphenylene sulfides or polyolefins are used for the regulating member, magnetic toner can leave the regulating member with significantly increased easiness. As a result, toner is less melt-adhered on the regulating member and therefore even when the toner is used in a large-capacity process cartridge or in a developing apparatus with high process speed under a high-temperature, high-humidity environment, less image density non-uniformity and streaks due to toner melt adhesion occur.

By using the regulating member and the magnetic toner-carrying member described above and adjusting the W/B within the above range, magnetic spikes can be for the first time effectively controlled small, thin and uniform even when the toner is applied to a developing apparatus with high process speed.

It is believed that magnetic spikes can be thin and uniform because magnetic spikes are prevented to cohere each other due to preferable substitution of magnetic toner at the regulating portion by the regulating member and the magnetic toner-carrying member and electrostatic repulsion between silica fine powder which abundantly exist on the surface of the magnetic toner particles. As a result, selective development can be significantly suppressed even when a large-capacity process cartridge is used or toner is used in a developing apparatus with high process speed, and low image density or fogging after toner is left to stand after a long durability test can be significantly suppressed because toner can be effectively and rapidly charged due to improved substitution at the regulating portion.

When the W/B is less than 2.5, magnetic toner may not be sufficiently substituted at the regulating portion, the effect for reducing adhesion strength may not be sufficiently exhibited and image quality may be deteriorated by image density non-uniformity, streaks and the like due to toner melt adhesion.

On the other hand, when the W/B is more than 10.0, even when magnetic toner is substituted preferably, magnetic toner tends to be charged up and charge amount distribution is not uniform to deteriorate image quality by fogging and the like.

The W/B can be controlled within the above range by controlling particle diameter distribution and true density of magnetic toner and adjusting the amount of the silica fine powder to be added.

<Method of Calculating Theoretical Specific Surface Area B Determined from Particle Diameter Distribution of Magnetic Toner>

The theoretical specific surface area B determined from particle diameter distribution of magnetic toner is calculated as follows.

The measurement instrument used is a "Coulter Counter Multisizer 3" (registered trademark, from Beckman Coulter, Inc.), a precision particle size distribution measurement instrument operating on the pore electrical resistance principle and equipped with a 100 μm aperture tube. The measurement conditions are set and the measurement data are analyzed using the accompanying dedicated software, i.e., "Beckman Coulter Multisizer 3 Version 3.51" (Beckman Coulter, Inc.). The measurements are carried at 25000 channels for the number of effective measurement channels.

The aqueous electrolyte solution used for the measurements is prepared by dissolving special-grade sodium chloride in ion-exchanged water to provide a concentration of approximately 1 mass % and, for example, "ISOTON II" (Beckman Coulter, Inc.) can be used. The dedicated software is configured as follows prior to measurement and analysis.

In the "modify the standard operating method (SOM)" screen in the dedicated software, the total count number in the control mode is set to 50000 particles; the number of measurements is set to 1 time; and the Kd value is set to the value obtained using "standard particle 10.0 μm" (Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush". In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL round bottom glass beaker intended for use with the Multisizer 3 and this is placed in the sample stand and counterclockwise stirring with the stirrer rod is carried out at 24 rotations per second. Contamination and air bubbles within the aperture tube have previously been removed by the "aperture flush" function of the dedicated software.

(2) Approximately 30 mL of the above-described aqueous electrolyte solution is introduced into a 100-mL flat bottom glass beaker. To this is added as dispersant approximately 0.3 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. A predetermined amount of ion-exchanged water is introduced into the water tank of this ultrasound disperser and approximately 2 mL of Contaminon N is added to the water tank.

(4) The beaker described in (2) is set into the beaker holder opening on the ultrasound disperser and the ultrasound disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of magnetic toner is added to the aqueous electrolyte solution in small aliquots and dispersion is carried out. The ultrasound dispersion treatment is continued for an additional 60 seconds. The water temperature in the water bath is controlled as appropriate during ultrasound dispersion to be 10° C. or higher and 40° C. or lower.

(6) Using a pipette, the dispersed magnetic toner-containing aqueous electrolyte solution prepared in (5) is dripped into the round bottom beaker set in the sample stand as described in (1) with adjustment to provide a measurement concentration of approximately 5%. Measurement is then performed until the number of measured particles reaches 50000.

(7) The measurement data is analyzed by the above dedicated software provided with the instrument and the theoretical specific surface area is calculated as follows. First, the results for the following 16 channels are calculated on the "analysis/number statistical value (arithmetic mean)" screen when set to graph/number % with the dedicated software. Specifically, measured particle diameter distribution (i.e., number statistical values) of the toner sample is divided into the following 16 channels and number % of particle diameter within each range is calculated.

| Number | | |
|---|---|---|
| CH | Range | DIF % |
| 1 | 1.587 to 2.000 μm | $N_1$ |
| 2 | 2.000 to 2.520 μm | $N_2$ |
| 3 | 2.520 to 3.175 μm | $N_3$ |
| 4 | 3.175 to 4.000 μm | $N_4$ |
| 5 | 4.000 to 5.040 μm | $N_5$ |
| 6 | 5.040 to 6.350 μm | $N_6$ |
| 7 | 6.350 to 8.000 μm | $N_7$ |
| 8 | 8.000 to 10.079 μm | $N_8$ |
| 9 | 10.079 to 12.699 μm | $N_9$ |
| 10 | 12.699 to 16.000 μm | $N_{10}$ |
| 11 | 16.000 to 20.159 μm | $N_{11}$ |
| 12 | 20.159 to 25.398 μm | $N_{12}$ |
| 13 | 25.398 to 32.000 μm | $N_{13}$ |
| 14 | 32.000 to 40.317 μm | $N_{14}$ |
| 15 | 40.317 to 50.797 μm | $N_{15}$ |
| 16 | 50.797 to 64.000 μm | $N_{16}$ |

Next, it is assumed that the particles within each particle diameter range are true sphere particles having the particle diameter at exactly the middle of each range and the true density of d (g/cm$^3$) (for example, particles in the range of 1.587 to 2.000 μm are assumed that they all have the diameter of 1.7935 μm). Then, the surface area of one particle in each range and the number % of particles in the range are used to calculate the theoretical specific surface area (m$^2$/g) of the magnetic toner. Namely, provided that Rn (m) is the radius at the middle of a range and Nn (number %) is the number % of that range, the theoretical specific surface area B determined from the particle diameter distribution of magnetic toner can be calculated as follows by accumulating calculations for all ranges in question.

$$\text{Theoretical specific surface area } B\ (\mathrm{m}^2/\mathrm{g}) = \{\Sigma(4\pi Rn^2 \times Nn)\}/[\Sigma\{(4/3)\pi Rn^3 \times Nn \times d \times 10^{-6}\}]$$

(wherein n=1 to 16).

In the present invention, the true density d of magnetic toner is measured on an automatic dry-type densitometer "Accupyc 1330" from Shimadzu Corporation according to the accompanying operation manual of the instrument.

In the present invention, the theoretical specific surface area B is preferably 0.3 m$^2$/g or more and 1.5 m$^2$/g or less and more preferably 0.4 m$^2$/g or more and 1.2 m$^2$/g or less. For example, the specific surface area may be measured by the BET method based on nitrogen adsorption. According to the BET method, not only surface irregularity but also accurate specific surface area at the level of pores can be determined. However, in order to exhibit the effect of the present invention as much as possible, it is important to control substitution of magnetic toner at the regulating portion and it is more suitable to use, in order to adjust the W/B, the theoretical specific surface area B calculated from the magnetic toner particle diameter distribution than to use one calculated with the BET method.

The reason for this is not clearly elucidated. However, the present inventors think that in order to actually adjust substitution of magnetic toner at the regulating portion, it is better to control the W/B in consideration of difference in magnetic toner particle diameter which may exhibit different behavior than by nitrogen adsorption which takes into account the level of pores.

In the present invention, the magnetic toner is the one having negative charging property obtained by externally adding, to magnetic toner particles, each of which contains a binder resin and magnetic powder, at least silica fine powder.

The silica fine powder can be suitably exemplified by the one called as dry silica or humed silica which is fine powder produced by vapor phase oxidation of a silicon halide. For example, the basic reaction formula which utilizes thermal decomposition oxidation reaction of silicon tetrachloride gas in oxygen and hydrogen is as follows.

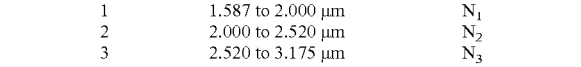

$$SiCl_4 + 2H_2 + O_2 \rightarrow SiO_2 + 4HCl$$

In this production step, complex fine powder of silica and other metal oxides can be obtained by, for example, using other metal halides such as aluminum chloride or titanium chloride with the silicon halide. Such complex fine powder is also encompassed.

Commercially available silica fine powder produced by vapor phase oxidation of silicon halides may include the ones marketed with the following trade names, for example.

AEROSIL® 130, 200, 300, 380, TT600, MOX170, MOX80, COK84; all from Nippon Aerosil Co., Ltd.

Ca—O-SiLM-5, MS-7, MS-75, HS-5, EH-5; all from CABOT Co.

Wacker HDK® N20, V15, N20E, T30, T40; all from WACKER-CHEMIE GMBH D-C Fine SiliCa (Dow Corning CO.)

Fransol (Fransil)

It is more preferable to use modified silica fine powder obtained by hydrophobic treatment of the silica fine powder produced by vapor phase oxidation of silicon halides. It is particularly preferable that the modified silica fine powder is obtained by treating the silica fine powder so as to obtain the hydrophobicity measured by the methanol titration test in the range of 30 to 80.

The method of hydrophobic treatment can be exemplified by the method in which the silica fine powder is chemically treated with an organosilicon compound and/or silicone oil which reacts with or is physically adsorbed to the inorganic fine powder. It is preferable that the silica fine powder produced by vapor phase oxidation of silicon halides is treated with the organosilicon compound.

The organosilicon compound may include hexamethyldisilazane, trimethylsilane, trimethylchlorosilane, trimethylethoxylsilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxylsilane, dimethyldimethoxysilane, diphenyldiethoxylsilane, hexamethyldisiloxane, 1,3-divinyltetramethyldisiloxane, 1,3-diphenyltetramethyldisiloxane and dimethylpolysiloxanes which contain 2 to 12 siloxane units per molecule and one hydroxy group per Si of the terminally located unit(s). These may be used as one or a mixture of two or more compounds.

Nitrogen atom-containing silane coupling agents such as aminopropyltrimethoxysilane, aminopropyltriethoxylsilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltriethoxylsilane, trimethoxysilyl-γ-propylphenylamine, trimethoxysilyl-γ-propylbenzylamine may be used alone or in combination. Preferable silane coupling agents may include hexamethyldisilazane (HMDS).

The silicone oil preferably has the viscosity at 25° C. of 0.5 to 10000 $mm^2/S$, more preferably 1 to 1000 $mm^2/S$ and still more preferably 10 to 200 $mm^2/S$. Specifically, dimethyl silicone oil, methylphenyl silicone oil, α-methylstyrene modified silicone oil, chlorophenyl silicone oil and fluorine modified silicone oil may be included.

Treatment method with silicone oil may include, for example, a method in which silica fine powder treated with a silane coupling agent and silicone oil are directly mixed in a mixer such as a Henschel mixer; a method in which silicone oil is sprayed on a base silica fine powder; and a method in which silicone oil is dissolved or dispersed in an appropriate solvent to which silica fine powder is added and mixed therein and then the solvent is removed.

The silicone oil-treated silica is more preferably heated in an inert gas at 200° C. or more (more preferably 250° C. or more) to stabilize the coating on the surface.

In the present invention, the silica fine powder is preferably treated with the coupling agent preliminarily and then treated with silicone oil, or treated with the coupling agent and silicone oil simultaneously in view of hydrophobicity.

In the present invention, the silica fine powder has the number-average particle diameter (D1) of the primary particles of 5 nm or more and 50 nm or less. In the present invention, the number-average particle diameter (D1) of the primary particles of the silica fine powder is measured by observing the silica fine powder alone before externally adding to the magnetic toner under magnification with a scanning electron microscope or by observing the surface of the magnetic toner to which the silica fine powder has been externally added under magnification. In these observations, particle diameters of at least 300 primary particles of silica fine powder are measured and the primary particle number-average particle diameter (D1) is obtained by arithmetically averaging the maximum diameters of the primary particles.

When the silica fine powder has the number-average particle diameter (D1) of the primary particles within the above range, a spacer effect can be exhibited due to the control of the W/B and reduction in adhesion strength and control of magnetic spikes can be highly achieved.

In the present invention, the magnetic toner may be externally added with fine powder other than the silica fine powder, which may include, for example, fluororesin powder such as vinylidene fluoride fine powder and polytetrafluoroethylene fine powder, titanium oxide fine powder, alumina fine powder and treated titanium oxide fine powder and treated alumina fine powder obtained by treating titanium oxide or alumina fine powder with silane coupling agents, titanium coupling agents, silicone oil and the like, and titanates and/or silicates with magnesium, zinc, cobalt, manganese, strontium, cerium, calcium, barium and the like. Two or more of them may be used in combination.

In the present invention, the magnetic toner preferably comprises strontium titanate fine powder because it has the effect as a microcarrier described below and can particularly exhibit the effect of the present invention. More preferably, the strontium titanate fine powder is, for example, produced by the sintering method, subjected to mechanical pulverization and pneumatically classified, so that particle size distribution is controlled.

In the present invention, the strontium titanate fine powder is used, relative to 100 mass parts of the magnetic toner, at 0.10 to 10 mass parts and more preferably 0.20 to 8 mass parts. The strontium titanate fine powder externally added to the magnetic toner has, as described above, the effect as a microcarrier. In the present invention, the magnetic toner can be effectively substituted at the magnetic toner-carrying member and the regulating portion of the regulating member and can retain stabilized charge amount by repetitive charging and lessening of charge. It is preferable to further add the strontium titanate fine powder because the effect as the microcarrier can be exhibited and charging and lessening of charge between magnetic toner particles are effectively carried out, so that further uniform charge amount distribution can be easily obtained.

Namely, by adding the strontium titanate fine powder, selective development can be further prevented and simultaneously the magnetic toner is charged effectively even upon image printing after it has been left to stand, thereby further improving the phenomena such as low image density and fogging after standing.

In the present invention, it is preferable that the magnetic toner-carrying member has the surface roughness (arithmetic-mean roughness: RaS) of 0.60 μm or more and 1.50 μm or less and the ratio [RaS/RaB] of the surface roughness (arithmetic-mean roughness: RaS) of the magnetic toner-carrying member to the surface roughness (arithmetic-mean roughness: RaB) of the portion, of the toner regulating member, which contacts the magnetic toner is 1.0 or more and 3.0 or less, because magnetic toner at the regulating portion can be substituted further preferably. The magnetic toner-carrying member more preferably has the surface roughness (arithmetic-mean roughness: RaS) of 0.80 μm or more and 1.30 μm or less and the [RaS/RaB] is more preferably 1.5 or more and 2.5 or less.

When the RaS is less than 0.60 μm, the magnetic toner is not sufficiently transported and it is difficult to improve the substitution. The magnetic toner is less transported, and particularly when an image having high coverage rate is printed out, the supply of the magnetic toner may be insufficient and problems such as image density non-uniformity and low density may occur. Further, depending on the type of materials of the regulating member and usage environments, toner may melt-adhered onto the regulating member and the magnetic toner-carrying member and tends to cause problems such as image density non-uniformity and streaks. On the other hand, when the magnetic toner-carrying member has the surface roughness RaS of more than 1.50 μm, the amount of magnetic toner transported is too high and eventually substitution of toner may be insufficient. In addition, the magnetic toner coat layer may be destabilized and as a result the charge amount distribution of the magnetic toner may be non-uniform and problems such as fogging and low density may occur.

By adjusting the irregularity on the surface of the magnetic toner-carrying member within the above range, substitution at the regulating portion can be improved, however, the magnetic toner in the vicinity of the regulating member which is relatively distant from the magnetic toner-carrying member may not be much affected.

Accordingly, in the present invention, RaS/RaB is adjusted to 1.0 or more and 3.0 or less, so that substitution in the vicinity of the regulating member can be preferably further improved.

When the RaS/RaB is less than 1.0, the transporting property of the magnetic toner-carrying member is relatively reduced and therefore the magnetic toner may be more accumulated in the vicinity of the regulating member.

On the other hand, when the RaS/RaB is more than 3.0, the irregularity of the regulating member is relatively low and substitution in the vicinity of the regulating member tends to be deteriorated.

The magnetic toner-carrying member of the present invention having the surface roughness (RaS) within the above range can be obtained by, for example, altering the ground condition of the surface layer of the magnetic toner-carrying member or by adding spherical carbon particles, carbon fine particles, graphite, resin fine particles and the like. The surface roughness (RaB) of the regulating member can be adjusted by applying taper grinding on the surface of the regulating member.

The magnetic toner of the present invention may contain a wax. Any known wax can be used for this wax. Specific examples are petroleum waxes, e.g., paraffin wax, microcrystalline wax, and petrolatum, and their derivatives; montan waxes and their derivatives; hydrocarbon waxes provided by the Fischer-Tropsch method and their derivatives; polyolefin waxes, as typified by polyethylenes and polypropylenes, and their derivatives; natural waxes, e.g., carnauba wax and candelilla wax, and their derivatives; and ester waxes. The derivatives include oxidized products, block copolymers with vinyl monomers, and graft modifications. In addition, the ester wax can be a monofunctional ester wax or a multifunctional ester wax, e.g., most prominently a bifunctional ester wax but also a tetrafunctional or hexafunctional ester wax. When a wax is incorporated in the magnetic toner of the present invention, its content is preferably from 0.5 mass parts or more and 10 mass parts or less relative to 100 mass parts of the binder resin. When the wax content is in the indicated range, the fixing performance is enhanced while the storage stability of the magnetic toner is not impaired.

The wax can be incorporated in the binder resin by, for example, a method in which, during resin production, the resin is dissolved in a solvent, the temperature of the resin solution is raised, and addition and mixing are carried out while stirring, or a method in which addition is carried out during melt kneading while the magnetic toner is produced.

The peak temperature (also referred to below as the melting point) of the highest endothermic peak measured on the wax using a differential scanning calorimeter (DSC) is preferably 60° C. or higher and 140° C. or lower and more preferably 70° C. or higher and 130° C. or lower. When the peak temperature of the highest endothermic peak is 60° C. or higher and 140° C. or lower, the magnetic toner is easily plasticized during fixing and the fixing performance is enhanced. This is also preferred because it works against the appearance of outmigration by the wax even during long term storage.

The peak temperature of the highest endothermic peak of the wax is measured in the present invention based on ASTM D3418-82 using a "Q1000" differential scanning calorimeter (TA Instruments, Inc.). Temperature correction in the instrument detection section is carried out using the melting points of indium and zinc, while the heat of fusion of indium is used to correct the amount of heat.

Specifically, approximately 10 mg of the wax is precisely weighed out and this is introduced into an aluminum pan. Using an empty aluminum pan as the reference, the measurement is performed at a rate of temperature rise of 10° C./min in the measurement temperature range from 30 to 200° C. For the measurement, the temperature is raised to 200° C. and is then dropped to 30° C. and is thereafter raised again. The peak temperature of the highest endothermic peak is determined from the DSC curve in the temperature range of 30 to 200° C. for this second temperature ramp-up step.

The binder resin for the magnetic toner of the present invention may include vinyl resins, polyester resins and the like and may be any conventionally known resin without limitation.

Specifically, styrene-based copolymers such as polystyrene, styrene-propylene copolymers, styrene-vinyltoluene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-octyl methacrylate copolymers, styrene-butadiene copolymers, styrene-isoprene copolymers, styrene-maleic acid copolymers and styrene-maleic ester copolymers; polyacrylate esters, polymethacrylate esters, polyvinyl acetate and the like can be used alone or in combination of more than one. Among these, styrene-based copolymers and polyester resins are preferable in view of developing characteristic, fixing performance and the like.

The magnetic toner of the present invention preferably has a glass transition temperature (Tg) of 45° C. or more and 70° C. or less. When the glass transition temperature is 45° C. or more and 70° C. or less, preferable fixing performance can be maintained while improving storage stability and durability as well.

The magnetic toner of the present invention preferably contains the magnetic powder described hereinbelow and has magnetic properties within specific ranges. Namely, in the present invention, the magnetic toner preferably has a saturation magnetization $\sigma s$ of 35 $Am^2/kg$ or more and 45 $Am^2/kg$ or less at a measurement magnetic field of 795.8 kA/m, and a residual magnetization $\sigma r$ of 3.0 $Am^2/kg$ or less at a measurement magnetic field of 795.8 kA/m. Further, the magnetic toner more preferably has the saturation magnetization $\sigma s$ at a measurement magnetic field of 795.8 kA/m of 37 $Am^2/kg$ or more and 42 $Am^2/kg$ or less and the residual magnetization $\sigma r$ of 2.5 $Am^2/kg$ or less.

By adjusting the magnetic properties of the magnetic toner within the above ranges, namely, by relatively increasing the saturation magnetization $\sigma s$ and relatively decreasing the residual magnetization $\sigma r$, it becomes easy to form uniform spikes on the magnetic toner-carrying member. This is believed to be due to the following reasons; by adjusting the saturation magnetization $\sigma s$ within a certain range, stable magnetic spikes can be formed and at the same time by reducing the residual magnetization $\sigma r$, magnetic cohesion may be decreased. Compared to the spikes having non-uniform thickness and length, uniform spikes tends to be disintegrated by weak shear force, so that the substitution at the regulating portion as described above can be further improved.

As the result of adjusting the magnetic properties within the above ranges, low image density and fogging and image density non-uniformity and streaks due to toner melt adhesion after standing for a long term durability test can be further suppressed.

Particularly, even when the saturation magnetization σs is 35 $Am^2/kg$ or more and 45 $Am^2/kg$ or less, magnetic cohesion of the magnetic toner tends to be increased when the residual magnetization σr is more than 3.0 $Am^2/kg$, so that suppression of low image density and fogging may be decreased after standing for a long term durability test.

The magnetic properties of the magnetic toner can be appropriately adjusted by magnetic properties and amount of the magnetic powder.

The magnetic powder which is used for the magnetic toner according to the present invention contains iron oxide such as triiron tetraoxide and γ-iron oxide as a main component and may contain phosphorous, cobalt, nickel, copper, magnesium, manganese, aluminum, silicon and the like elements. Particularly, the magnetic powder containing phosphorous and silicon is preferable because the magnetic properties can be further easily adjusted. The magnetic powder preferably has a BET specific surface area according to the nitrogen adsorption method of 2 $m^2/g$ to 30 $m^2/g$ and more preferably 3 $m^2/g$ to 20 $m^2/g$. The magnetic powder preferably has the Mohs hardness of 5 to 7.

The magnetic powder suitably has a spherical, polyhedral, hexahedral or the like shape in view of that the adjustment to the magnetic properties which are suitable for the present invention is easily carried out. The shape of the magnetic powder can be verified with a scanning electron microscope (SEM) or a transmission electron microscope (TEM). When there is a distribution in the shape, the shape of the magnetic powder is defined as the most frequent shape among the existing shapes.

The magnetic powder of the present invention preferably has, in view of that the magnetic properties of the magnetic toner is adjusted, has a saturation magnetization σs at a measurement magnetic field of 795.8 kA/m of 75 $Am^2/kg$ or more and 85 $Am^2/kg$ or less, more preferably 77 $Am^2/kg$ or more and 83 $Am^2/kg$ or less. On the other hand, the magnetic powder preferably has a residual magnetization σr at a measurement magnetic field of 795.8 kA/m of 1.0 $Am^2/kg$ or more and 5.0 $Am^2/kg$ or less and more preferably 1.0 $Am^2/kg$ or more and 4.5 $Am^2/kg$ or less.

The magnetic powder preferably has the number-average particle diameter of 0.05 to 0.40 μm. When the number-average particle diameter is less than 0.05 μm, black chromaticity is significantly decreased and tinting strength may be insufficient as well as dispersibility may be decreased because cohesion between magnetic powder particles becomes strong. In addition, because the surface area of the magnetic powder is increased, the residual magnetization of the magnetic powder is also increased, resulting in increase in residual magnetization of the magnetic toner.

On the other hand, when the number-average particle diameter is more than 0.40 μm, although the residual magnetization is decreased, tinting strength may be insufficient. In addition, it becomes stochastically difficult to uniformly disperse magnetic powder onto individual magnetic toner particles, resulting in decrease in dispersibility.

The number-average particle diameter of magnetic particles corresponds to the arithmetic mean value of the maximum diameter obtained by observing randomly chosen 300 particles on a transmission electron micrograph (magnification: 30000-fold).

In the present invention, the saturation magnetization σs and the residual magnetization σr of the magnetic powder and the magnetic toner are measured on a vibrating magnetometer VSM P-1-10 (Toei Industry Co., Ltd.) at a room temperature of 25° C. and an external magnetic field of 795.8 kA/m.

The content of the magnetic powder is preferably, relative to 100 mass parts of the binder resin, 40 to 150 mass parts, more preferably 50 to 120 mass parts and particularly preferably 75 to 110 mass parts in view of controlling the magnetic properties and the distribution of the charge amount of the magnetic toner of the present invention.

The content of the magnetic powder in the magnetic toner can be measured with a thermal analyzer TGA Q5000IR from PerkinElmer Inc. With regard to the measurement method, the magnetic toner is heated from normal temperature to 900° C. under a nitrogen atmosphere at a rate of temperature rise of 25° C./minute, the mass loss from 100° C. to 750° C. is taken to be the amount of the component obtained by excluding the magnetic powder from the magnetic toner, and the residual mass is taken to be the amount of the magnetic powder. The magnetic powder which is used for the present invention can be produced by the following method, for example. To an aqueous solution of a ferrous salt is added an alkaline such as sodium hydroxide at an iron-component equivalent or more to prepare an aqueous solution of ferrous hydroxide. While the prepared aqueous solution is maintained at pH 7 or more, air is bubbled into the aqueous solution which is heated at 70° C. or more to carry out oxidation reaction of ferrous hydroxide, thereby prepare seed crystals which serve as cores for magnetic iron oxide powder.

Next, the slurry containing the seed crystals is added with an aqueous solution containing approximately 1 equivalent of ferrous sulfate on the basis of the amount of alkaline added previously. While the solution is maintained at pH 5 or more and 10 or less, air is bubbled to proceed reaction of ferrous hydroxide in order to grow magnetic iron oxide powder with the seed crystals as cores. By selecting any pH, reaction temperature and stirring conditions in this step, it is possible to control the shape and magnetic properties of the magnetic powder. With the progress of the oxidation reaction, pH shifts toward acidic; however, it is preferable that the pH of the solution does not go below 5. The thus obtained magnetic substance is filtered, washed and dried according to conventional methods to obtain magnetic powder.

The magnetic toner according to the present invention may be added with a charge control agent if necessary in order to improve the charge property. In the present invention, as the magnetic toner has negative charging property, it is preferable to add a charge control agent having negative charging property.

Organometal complex compounds and chelate compounds are effective as charge control agents for negative charging and can be exemplified by monoazo-metal complex compounds; acetylacetone-metal complex compounds; and metal complex compounds of aromatic hydroxycarboxylic acids and aromatic dicarboxylic acids. Specific examples of the commercially available products may include, for example, Spilon Black TRH, T-77 and T-95 (Hodogaya Chemical Co., Ltd.) and BONTRON® S-34, S-44, S-54, E-84, E-88 and E-89 (Orient Chemical Industries Co., Ltd.).

One of these charge control agents or two or more of them in combination can be used. The amount of the charge control agent to be used is preferably, per 100 mass parts of the binder resin, 0.1 to 10.0 mass parts in view of the charge amount of the magnetic toner, and more preferably, 0.1 to 5.0 mass parts.

The magnetic toner of the present invention preferably has the average circularity of 0.935 or more and 0.955 or less and more preferably 0.938 or more and 0.950 or less in view of suppressing excessive charging. The average circularity of the magnetic toner can be adjusted to the above range by generally adjusting the method of producing the magnetic toner and the production conditions.

The production method of the magnetic toner of the present invention is exemplified hereinbelow, which do not limit the present invention.

The magnetic toner of the present invention is preferably produced by a method comprising the step of adjusting the average circularity. Other steps in the production are not particularly limited and the magnetic toner may be produced by known production methods.

Such a production method can by suitably exemplified by the following method.

First, materials such as the binder resin and magnetic powder and an optional wax and a charge control agent are thoroughly mixed using a mixer such as a Henschel mixer or ball mill and are then melted, worked, and kneaded using a heated kneading apparatus such as a roll, kneader, or extruder to compatibilize the resins with each other. The obtained melted and kneaded material is cooled and solidified and then pulverized and classified, and at least silica fine powder is externally added and mixed with the above mixer to obtain the magnetic toner.

The mixer may include the Henschel mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation).

The kneading apparatus may include the KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

An apparatus for pulverization described above may include the Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

Among the preceding, the average circularity can be controlled by adjusting the exhaust gas temperature during fine pulverization using a Turbo Mill. A lower exhaust gas temperature (for example, 40° C. or lower) provides a smaller value for the average circularity while a higher exhaust gas temperature (for example, around 50° C.) provides a higher value for the average circularity.

An apparatus for classification described above may include the Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen the coarse particles may include the Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

The magnetic toner of the present invention preferably has the weight-average particle diameter (D4) of 6.0 to 11.0 μm and more preferably 7.0 to 10.0 μm. The magnetic toner having the weight-average particle diameter (D4) within the above range can favorably suppress production of fogging and spots around line images while providing highly fine images.

As described above, the present invention relates to a developing apparatus comprising an electrostatic latent image bearing member on which an electrostatic latent image is formed, magnetic toner for developing the electrostatic latent image, a magnetic toner-carrying member arranged so as to oppose the electrostatic latent image bearing member for carrying and transporting the magnetic toner, and a toner regulating member contacting the magnetic toner-carrying member and regulating the magnetic toner carried on the magnetic toner-carrying member. The developing apparatus of the preset invention is characterized in that the work function value at the surface of the magnetic toner-carrying member is within a specific range, the regulating member contains a polyphenylene sulfide or a polyolefin at a portion contacting the magnetic toner and it comprises the magnetic toner of the present invention.

The developing apparatus of the present invention is described in detail hereinbelow by means of figures, which do not limit the present invention.

Figure 2:
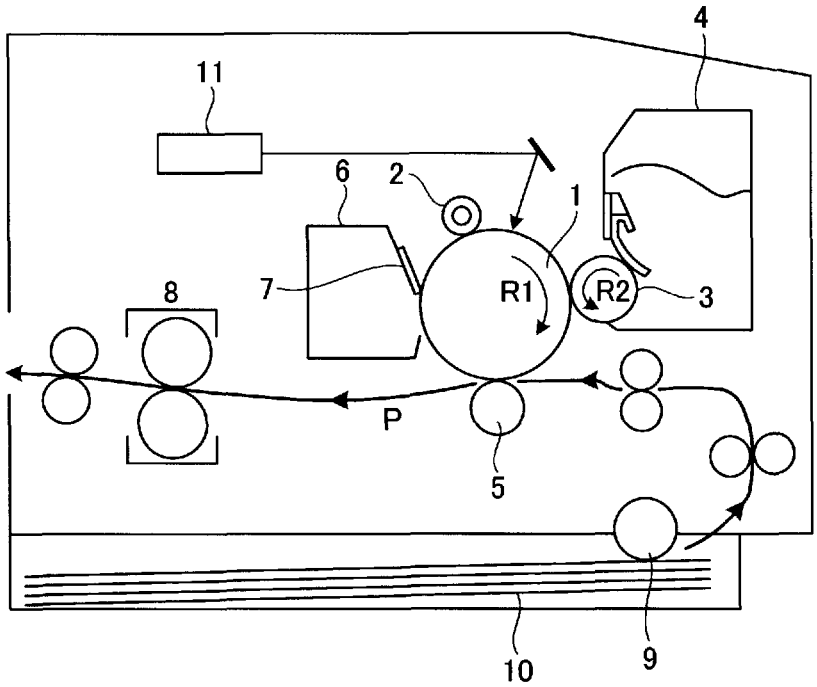
FIG. 2 is a schematic sectional diagram that shows an example of an image-forming apparatus.
Figure 3:
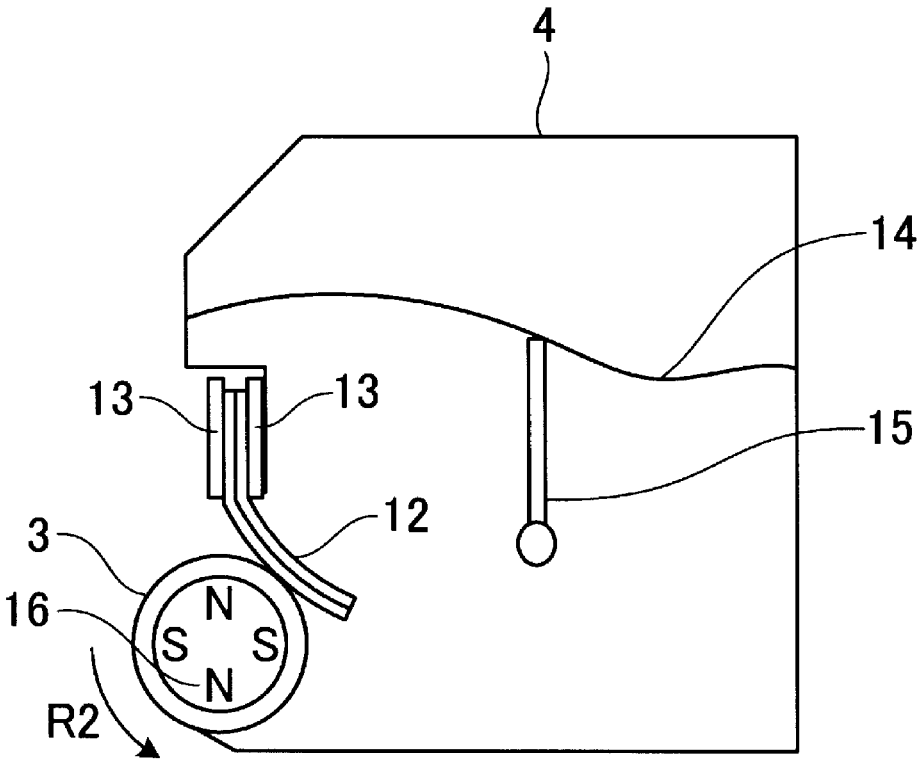
FIG. 3 is a schematic sectional diagram that shows an example of a developing apparatus.

FIG. 3 is a schematic sectional diagram that shows an example of the developing apparatus of the present invention. FIG. 2 is a schematic sectional diagram that shows an example of the image-forming apparatus containing the developing apparatus of the present invention.

In FIG. 2 or 3, an electrostatic latent image bearing member (photosensitive member) 1 which is the image bearing member onto which an electrostatic latent image has been formed rotates along the direction of the arrow R1. A magnetic toner-carrying member 3 carries magnetic toner 14 in a developing device 4 and rotates along the direction of the arrow R2, so that the magnetic toner 14 is transported to a developing zone where the magnetic toner-carrying member 3 opposes to the electrostatic latent image bearing member (photosensitive member) 1. In the magnetic toner-carrying member 3, a magnet 16 is provided in order to magnetically attract and retain the magnetic toner on the magnetic toner-carrying member 3.

A charging roller 2, a transfer member (transfer roller) 5, a cleaner container 6, a cleaning blade 7, a fixing unit 8, a pick-up roller 9 and the like are disposed on the circumference of the electrostatic latent image bearing member (photosensitive member) 1. The electrostatic latent image bearing member (photosensitive member) 1 is charged by the charging roller 2. Photoexposure is performed by irradiating the electrostatic latent image bearing member (photosensitive member) 1 with laser light from a laser generator 11 to form an electrostatic latent image corresponding to the intended image. The electrostatic latent image on the electrostatic latent image bearing member (photosensitive member) 1 is developed with the magnetic toner in the developing device 4 to provide a toner image. The toner image is transferred onto a transfer material (paper) 10 by the transfer member (transfer roller) 5, which contacts the electrostatic latent image bearing member (photosensitive member) 1 with the transfer material interposed therebetween. The transfer material (paper) 10 containing the toner image is conveyed to the fixing unit 8 and fixing on the transfer material (paper) 10 is carried out. In addition, the magnetic toner 14 remaining to some extent on the electrostatic latent image bearing member (photosensitive member) 1 is scraped off by the cleaning blade 7 and stored in the cleaner container 6.

In the step of charging carried out in the developing apparatus of the present invention, a contact charging apparatus is preferably used in which the electrostatic latent image bearing member contacts a charging roller by forming a contact portion and certain charging bias is applied to the charging roller to charge the surface of the electrostatic latent image bearing member at a desired polarity and potential. Such contact charging allows stable and uniform charging and can decrease the amount of ozone generated.

However, when a fixed type charging member is used, it is difficult to keep uniform contact between the charging member and the rotating electrostatic latent image bearing member, resulting in frequent generation of charge non-uniformity. In order to keep uniform contact with the electrostatic latent image bearing member and obtain uniform charging, the charging roller preferably rotates in the same direction as the electrostatic latent image bearing member.

Preferable process conditions when the charging roller is used can be exemplified by the contact pressure of the charging roller: 4.9 to 490.0 N/m (5.0 to 500.0 g/cm); and DC voltage or AC and DC superposed voltage. When AC voltage is superposed, it is preferable that AC voltage is 0.5 to 5.0 kVpp, the frequency of AC is 50 to 5 kHz, and DC voltage has the absolute value of 200 to 1500 V. The polarity of voltage depends on the developing apparatus to be used. The waveform of AC voltage used in the step of charging may be a sinusoidal wave, a square wave, a triangular wave and the like.

The material of an elastomer used for the charging roller may include, but not limited to, rubber materials obtained by dispersing a conductive substance such as carbon black or metal oxides in ethylene-propylene-diene rubbers (EPDMs), polyurethanes, butadiene acrylonitrole rubbers (NBRs), silicon rubbers, isoprene rubbers and the like in order to adjust the resistance and foamed materials thereof. It is also possible to adjust the resistance without dispersing the conductive substance or by using the conductive substance in combination with an ion conductive material.

A cored bar of the charging roller may include aluminum, SUS and the like. The charging roller is provided by pressing it against a member to be charged, i.e., the electrostatic latent image bearing member, at predetermined pressing pressure against elasticity, so that a charging contact portion is formed which is a contact portion between the charging roller and the electrostatic latent image bearing member.

In the developing apparatus of the present invention, in order to obtain high image quality without fogging, it is preferable that magnetic toner is applied on the magnetic toner-carrying member at a thickness thinner than the distance of the closest approach (between S-D) between the magnetic toner-carrying member and the electrostatic latent image bearing member and the applied magnetic toner is used for development of an electrostatic latent image in the step of development. Generally known regulating members for regulating magnetic toner on magnetic toner-carrying members include a magnetic cutting means and a regulating blade, among which a regulating blade is preferably used in the present invention. It is easy for the regulating blade to contain a polyphenylene sulfide or a polyolefin at a portion contacting the magnetic toner as described above.

In the present invention, the regulating member may be an article in the form of sheet obtained by molding a polyphenylene sulfide or a polyolefin as it is. Alternatively, it may be suitably a metal substrate (metal elastic body) onto which the resin is adhered or coated.

The polyolefin may be a polypropylene or a polyethylene and specifically Novatec PP FW4BT (Japan Polypropylene Corporation) and Thermorun 3855 (Mitsubishi Chemical Corporation) may be suitably used. The polyphenylene sulfide may be suitably Torelina (Toray Industries, Inc.). The toner regulating member is preferably the one obtained by bonding on a metal elastic body a polyolefin film (polypropylene film, polyethylene film etc.) or a polyphenylene sulfide film.

The polyphenylene sulfide and the polyolefin may contain other resins or additives at the level of 20 mass % or less in order to adjust the charging property and the like.

In the present invention, the regulating member may be an article in the form of sheet obtained by molding a polyphenylene sulfide or a polyolefin as it is. Alternatively, it may be suitably a metal elastic body (13 in FIG. 3) onto which the resin is adhered or coated. The contact pressure between the regulating member and the magnetic toner-carrying member is preferably, expressed as linear pressure in the generator direction of the magnetic toner-carrying member, 4.9 to 118.0 N/m (5 to 120 g/cm). When the contact pressure is lower than 4.9 N/m, it is difficult to uniformly apply the magnetic toner, which may cause fogging or spots around line images. On the other hand, when the contact pressure is higher than 118.0 N/m, high pressure is applied to the magnetic toner, which may cause deterioration of the magnetic toner.

The toner layer is preferably formed on the magnetic toner-carrying member at 7.0 $g/m^2$ or more and 18.0 $g/m^2$ or less. When the amount of the toner on the magnetic toner-carrying member is less than 7.0 $g/m^2$, sufficient image density may not be obtained. The reason for this is as follows: the amount of the toner developed on the electrostatic latent image bearing member is determined by [the amount of the toner on the magnetic toner-carrying member]×[the ratio of circumferential velocity of the magnetic toner-carrying member to that of the electrostatic latent image bearing member]×[development efficiency]; however, when the amount of the toner on the magnetic toner-carrying member is low, enough amount of the toner is not developed no matter how high the development efficiency is.

On the other hand, when the amount of the toner on the magnetic toner-carrying member is higher than 18.0 $g/m^2$, it may appear that enough image density could be obtained even when the development efficiency is low. However, it in fact tends to make uniform charging of the magnetic toner difficult and therefore the development efficiency is not sufficiently increased and sufficient image density may not be obtained. In addition, because uniform charging performance is deteriorated, the transfer property is decreased as well as fogging may be increased.

In the present invention, the amount of the toner on the magnetic toner-carrying member can be appropriately changed by changing the surface roughness (RaS) of the magnetic toner-carrying member, the free length of the regulating member or the contact pressure of the regulating member. The amount of the toner on the magnetic toner-carrying member is measured as follows: a cylindrical filter paper is attached at a suction nozzle having an outer diameter of 6.5 mm, which is then attached to a vacuum cleaner to vacuum the magnetic toner on the magnetic toner-carrying member. The vacuumed amount of the toner (g) is divided by the vacuumed area ($m^2$) to obtain the amount of the toner on the magnetic toner-carrying member.

The magnetic toner-carrying member which is used for the present invention is preferably a conductive cylindrical article made of metal or metal alloy such as aluminum, stainless steel and the like. The conductive cylindrical article may be made of a resin composition having sufficient mechanical strength and conductivity or may be a conductive rubber roller.

The magnetic toner-carrying member which is used for the present invention preferably contains a multipolar magnet fixed therein and the number of magnetic poles is preferably 3 to 10.

In the present invention, the step of development is preferably the step of applying an alternating electric field as developing bias onto the magnetic toner-carrying member, thereby transferring the magnetic toner to an electrostatic latent image on the electrostatic latent image bearing member to form a magnetic toner image. The developing bias to be applied may be DC voltage superposed with the alternating electric field.

The waveform of the alternating electric field may be a sinusoidal wave, a square wave, a triangular wave and the like as desired. It may be a wave pulse formed by periodically turning on/off an DC power supply. Accordingly, the waveform of the alternating electric field used may be a bias having the voltage value which alters periodically.

The developing method of the present invention is a method for developing an electrostatic latent image formed on an electrostatic latent image bearing member using magnetic toner that is carried on a magnetic toner-carrying member arranged so as to oppose the electrostatic latent image bearing member and that is regulated by a toner regulating member contacting the magnetic toner-carrying member, wherein:

the magnetic toner-carrying member has a work function value at the surface of 4.6 eV or more and 4.9 eV or less, a portion of the toner regulating member, which is contacting the magnetic toner, is made of a polyphenylene sulfide or a polyolefin, and the magnetic toner i) comprises magnetic toner particles, each of which contains a binder resin and magnetic powder, and silica fine powder, ii) has negative charging property, iii) has a ratio [W/B] of an amount W (mass % relative to the magnetic toner) of the silica fine powder to a theoretical specific surface area B ($m^2/g$) of the magnetic toner determined from particle diameter distribution (number statistical value) satisfies the following formula (1):

$$2.5 \leq W/B \leq 10.0. \quad (1)$$

The methods of measuring various physical properties according to the present invention are now described.

<Method of Measuring the Weight-Average Particle Diameter (D4) of the Magnetic Toner>

The weight-average particle diameter (D4) of the magnetic toner can be calculated by various methods. In the present invention, it is measured with a "Coulter Counter Multisizer 3" as the measurement of the theoretical specific surface area determined from the particle diameter distribution of the magnetic toner.

The weight-average particle diameter (D4) and the number-average particle diameter (D1) of the magnetic toner is calculated as follows. The measurement instrument used is a "Coulter Counter Multisizer 3" (registered trademark, Beckman Coulter, Inc.), a precision particle size distribution measurement instrument operating on the pore electrical resistance principle and equipped with a 100 μm aperture tube. The measurement conditions are set and the measurement data are analyzed using the accompanying dedicated software, i.e., "Beckman Coulter Multisizer 3 Version 3.51" (Beckman Coulter, Inc.). The measurements are carried at 25000 channels for the number of effective measurement channels.

The aqueous electrolyte solution used for the measurements is prepared by dissolving special-grade sodium chloride in ion-exchanged water to provide a concentration of approximately 1 mass % and, for example, "ISOTON II" (Beckman Coulter, Inc.) can be used.

The dedicated software is configured as follows prior to measurement and analysis.

In the "modify the standard operating method (SOM)" screen of the dedicated software, the total count number in the control mode is set to 50000 particles; the number of measurements is set to one time; and the Kd value is set to the value obtained using "standard particle 10.0 μm" (Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 ml of the above-described aqueous electrolyte solution is introduced into a 250-ml round bottom glass beaker intended for use with the Multisizer 3 and this is placed in the sample stand and counterclockwise stirring with the stirrer rod is carried out at 24 rotations per second. Contamination and air bubbles within the aperture tube have previously been removed by the "aperture flush" function of the dedicated software.

(2) Approximately 30 ml of the above-described aqueous electrolyte solution is introduced into a 100-ml flat bottom glass beaker. To this is added as dispersant approximately 0.3 ml of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of ion-exchanged water is introduced into the water tank of this ultrasound disperser and approximately 2 mL of Contaminon N is added to the water tank.

(4) The beaker described in (2) is set into the beaker holder opening on the ultrasound disperser and the ultrasound disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of magnetic toner is added to the aqueous electrolyte solution in small aliquots and dispersion is carried out. The ultrasound dispersion treatment is continued for an additional 60 seconds. The water temperature in the water bath is controlled as appropriate during ultrasound dispersion to be 10° C. or higher and 40° C. or lower.

(6) Using a pipette, the dispersed toner-containing aqueous electrolyte solution prepared in (5) is dripped into the round bottom beaker set in the sample stand as described in (1) with adjustment to provide a measurement concentration of approximately 5%. Measurement is then performed until the number of measured particles reaches 50000.

(7) The measurement data is analyzed by the above dedicated software provided with the instrument and the weight-average particle diameter (D4) and the number-average particle diameter (D1) are calculated. When set to graph/volume % with the dedicated software, the "average diameter" on the "analysis/volumetric statistical value (arithmetic mean)" screen is the weight-average particle diameter (D4), and when set to graph/number % with the dedicated software, the "average diameter" on the "analysis/number statistical value (arithmetic mean)" screen is the number-average particle diameter (D1).

<Method of Measuring Average Circularity of Magnetic Toner>

The average circularity of the magnetic toner is measured with the "FPIA-3000" (Sysmex Corporation), a flow particle imaging analyzer, using the measurement and analysis conditions from the calibration process.

The specific measurement method is as follows. First, approximately 20 mL of ion-exchanged water from which the solid impurities and so forth have previously been removed is placed in a glass container. To this is added as dispersant approximately 0.2 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant and organic builder, from Wako Pure Chemical Industries, Ltd.). Approximately 0.02 g of the measurement sample is also added and a dispersion treatment is carried out for 2 minutes using an ultrasound disperser to provide a dispersion for submission to measurement. Cooling is carried out as appropriate during this treatment so as to provide a dispersion temperature of 10° C. or higher and 40° C. or lower. The ultrasound disperser used here is a benchtop ultrasonic cleaner/disperser that has an oscillation frequency of 50 kHz and an electrical output of 150 W (for example, a "VS-150" from Velvo-Clear Co., Ltd.); a predetermined amount of ion-exchanged water is introduced into the water tank and approximately 2 mL of the aforementioned Contaminon N is also added to the water tank.

The previously cited flow-type particle image analyzer fitted with a regular objective lens (10-fold magnification) is used for the measurement, and Particle Sheath "PSE-900A" (Sysmex Corporation) is used for the sheath solution. The dispersion prepared according to the procedure described above is introduced into the flow-type particle image analyzer and 3000 magnetic toner particles are measured according to total count mode in HPF measurement mode. The average circularity of the magnetic toner is determined with the binarization threshold value during particle analysis set at 85% and the analyzed particle diameter limited to a circle-equivalent diameter of 1.985 μm or more and less than 39.69 μm.

For this measurement, automatic focal point adjustment is performed prior to the start of the measurement using reference latex particles (for example, a dilution with ion-exchanged water of "RESEARCH AND TEST PARTICLES Latex Microsphere Suspensions 5200A" from Duke Scientific). After this, focal point adjustment is preferably performed every 2 hours after the start of measurement.

In the present invention, the flow-type particle image analyzer used had been calibrated by the Sysmex Corporation and had been issued with a calibration certificate by the Sysmex Corporation. The measurements are carried out under the same measurement and analysis conditions as when the calibration certificate was received, with the exception that the analyzed particle diameter is limited to a circle-equivalent diameter of 1.985 μm or more and less than 39.69 μm.

The "FPIA-3000" flow-type particle image analyzer (Sysmex Corporation) uses a measurement principle based on capturing a still image of the flowing particles and performing image analysis. The sample added to the sample chamber is delivered by a sample suction syringe into a flat sheath flow cell. The sample delivered into the flat sheath flow is sandwiched by the sheath liquid to form a flat flow. The sample passing through the flat sheath flow cell is exposed to stroboscopic light at an interval of 1/60 seconds, thus enabling a still image of the flowing particles to be captured. Moreover, since flat flow is occurring, the photograph is taken under in-focus conditions. The particle image is captured with a CCD camera; the captured image is subjected to image processing at an image processing resolution of 512×512 pixels (0.37 μm×0.37 μm per pixel); contour definition is performed on each particle image; and, among other things, the projected area S and the periphery length L are measured on the particle image.

The circle-equivalent diameter and the circularity are then determined using this area S and periphery length L. The circle-equivalent diameter is the diameter of the circle that has the same area as the projected area of the particle image. The circularity is defined as the value provided by dividing the periphery length of the circle determined from the circle-equivalent diameter by the periphery length of the particle's projected image and is calculated using the following formula.

$$\text{Circularity}=2\times(\pi\times S)^{1/2}/L$$

The circularity is 1.000 when the particle image is a circle, and the value of the circularity declines as the degree of irregularity in the periphery of the particle image increases. After the circularity of each particle has been calculated, 800 are fractionated out in the circularity range of 0.200 to 1.000; the arithmetic average value of the obtained circularities is calculated; and this value is used as the average circularity.

<Method of Measuring Work Function Value at the Surface of Magnetic Toner-Carrying Member>

The work function value at the surface of the magnetic toner-carrying member is measured with a photoelectron spectrometer AC-2 [Riken Keiki Co., Ltd.] under the following conditions.

Irradiation energy: 4.2 eV to 6.2 eV
Light intensity: 300 nW
Count time: 10 sec/1 point
Plate voltage: 2900 V A measurement specimen is prepared by cutting the magnetic toner-carrying member into the size of 1 cm×1 cm. The specimen is scanned with UV light from 4.2 to 6.2 eV at an interval of 0.05 eV in the order from low to high energy level. Photoelectrons released at this time are counted and the work function value is calculated from the threshold in the quantum efficiency power plots.

Figure 4:
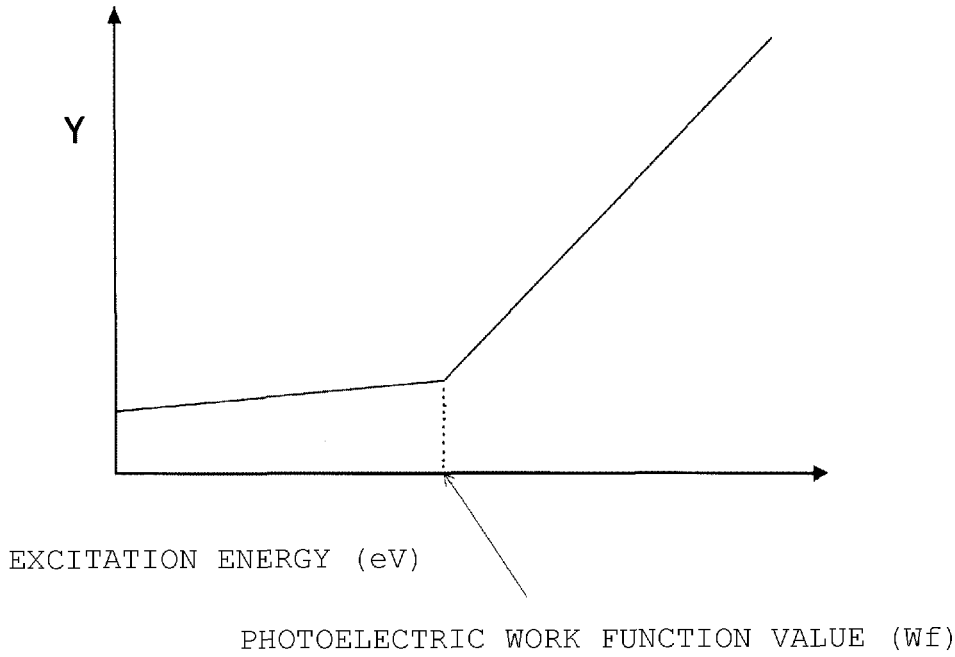
FIG. 4 is a diagram that shows an example of a work function measurement curve.

The work function measurement curve obtained from the measurements under the above conditions is show in FIG. 4. In FIG. 4, the X-axis represents the excitation energy [eV] and the Y-axis represents the value Y which is the 0.5th power of the number of released photoelectrons (normalized photon yield). Generally, when excitation energy exceeds a certain threshold, the amount of released photoelectrons, i.e., the normalized photon yield increases drastically and the work function measurement curve rises sharply. The point of rising is defined as the work function value [Wf].

<Method of Measuring Surface Roughness (RaS) and (RaB)>

The surface roughness (RaS) and (RaB) are based on the surface roughness of JIS B0601 (2001) [specifically, Ra: arithmetic-mean roughness] and are measured using a Surfcorder SE-3500 from Kosaka Laboratory Ltd. The measurement conditions are: cut-off: 0.8 mm, evaluation length: 8 mm and feed speed: 0.5 mm/s.

When the sample is the magnetic toner-carrying member, the average is taken for the measurement results carried out for total nine points which are the central point of the magnetic toner-carrying member and each middle point between the central point and both ends of the coating (total three points), similar three points after rotating the magnetic toner-carrying member for 90 degrees and three points after rotating the magnetic toner-carrying member for further 90 degrees. When the sample is the toner regulating member, the average is taken for the measurement results carried out for five points which are the center, both ends and each middle point between the center and both ends of the portion contacting the magnetic toner-carrying member.

<Method of Measuring Graphitization Degree d (002)>

The graphitized particles are loaded on a non-reflective sample plate and an X-ray diffraction chart is obtained on a horizontal sample mounting high power X-ray diffractometer RINT/TTR-II (trade name) from Rigaku Corporation with a CuKα source. The CuKα ray was monochromatized with a monochromator.

For the lattice spacing d (002) from this X-ray diffraction chart, peak positions of diffraction lines from graphite (002) plane based on the X-ray diffraction spectrum are determined and graphite d (002) is calculated from the Bragg formula (the following formula (2)). The wavelength λ of the CuKα ray is 0.15418 nm.

$$\text{Graphite } d(002)=\lambda/2\sin\theta \quad (2)$$

Measurement conditions:
Optical system: Parallel beam optical system
Goniometer: Rotor horizontal goniometer (TTR-2)
Tube voltage/current: 50 kV/300 mA
Measurement method: Continuous method
Scanning axis: 2θ/θ
Measurement angle: 10° to 50°
Sampling interval: 0.02°
Scanning speed: 4°/min
Divergence slit: Open
Divergence vertical slit: 10 mm
Scattering slit: Open
Receiving slit: 1.00 mm

EXAMPLES

The present invention is further specifically described by way of Examples and Comparative Examples hereinbelow, which by no means limit the present invention. Unless otherwise stated, "part(s)" and "%" in Examples and Comparative Examples are in mass basis.

<Production Example of Magnetic Toner-Carrying Member 1>

β-resins were extracted from coal-tar pitches by solvent fractionation and subjected to hydrogenation and heavy-duty treatment followed by removal of a solvent-soluble fraction with toluene to obtain a mesophase pitch. Powder of the mesophase pitch was finely pulverized and oxidized in air at approximately 300° C. followed by heat treatment in a nitrogen atmosphere at 2800° C. and classification to obtain graphitized particles A having the volume-average particle diameter of 3.4 μm and the graphitization degree p(002) of 0.39.

Next, 100 mass parts equivalent to a solid matter of a resol type phenolic resin (Dainippon Ink & Chemicals, Inc., trade name: J325) obtained by using an ammonium catalyst, 40 mass parts of conductive carbon black A (Degussa, trade name: Special Black 4), 60 mass parts of graphitized particles A and 150 mass parts of methanol were mixed and dispersed in a sand mill in which glass beads having a diameter of 1 mm were used as media particles for 2 hours to obtain an intermediate coating material M1.

The above resol type phenolic resin (50 mass parts equivalent to a solid matter), 30 mass parts of a quaternary ammonium salt (Orient Chemical Industries Co., Ltd., trade name: P-51), 30 mass parts of conductive spherical particles 1 (Nippon Carbon Co., Ltd., trade name: Nicabeads ICB 0520) and 40 mass parts of methanol were mixed and dispersed in a sand mill in which glass beads having a diameter of 2 mm were used as media particles for 45 minutes to obtain an intermediate coating material J1. The intermediate coating material M1 and the intermediate coating material J1 were mixed and stirred to obtain a coating solution B1.

To the coating solution B1 was then added methanol to adjust the solid matter concentration to 38%. A cylindrical tube having an outer diameter of 10 mm and the arithmetic-mean roughness Ra of 0.2 μm made of aluminum obtained by grinding processing was rotated on a rotating stage, applied with a masking on both ends and coated with the coating solution B1 on the surface thereof by descending an air spray gun at a constant velocity to form a conductive resin coat layer. The coating conditions were under the environment of 30° C./35% RH, and the coating was performed by controlling the temperature of the coating solution at 28° C. with a temperature-controlled bath. The conductive resin coat layer was then cured by heating in a hot air drying oven at 150° C. for 30 minutes to prepare a magnetic toner-carrying member 1 having the arithmetic-mean roughness Ra (RaS) of 0.95 μm. The magnetic toner-carrying member 1 was measured for the work function value at the surface to give 4.8 eV.

<Production Example of Magnetic Toner-Carrying Member 2>

A coating solution B2 was prepared by the same manner as above except that 10 mass parts of conductive carbon black B (Tokai Carbon Co., Ltd., trade name: #5500) was used instead of 40 mass parts of the conductive carbon black A and 90 mass parts of the graphitized particles A were used. The coating solution B2 was used in the same manner as above to prepare a magnetic toner-carrying member 2 having the arithmetic-mean roughness Ra (RaS) of 0.95 μm. The conductive resin coat layer of the magnetic toner-carrying member was measured for the work function value to obtain 4.6 eV.

<Production Example of Magnetic Toner-Carrying Members 3 to 9>

Magnetic toner-carrying members 3 to 9 were obtained in the same manner as the production of the magnetic toner-carrying member 1 except that the formulations shown in Table 1 were used. The compositions of the magnetic toner-carrying members 3 to 9 and physical properties of the obtained magnetic toner-carrying members are shown in Table 1.

TABLE 1

| | | Magnetic toner-carrying member | | | | | | | | |
|---|---|---|---|---|---|---|---|---|---|---|
| | | 1 | 2 | 3 | 4 | 5 | 6 | 7 | 8 | 9 |
| Conductive CB | #5500 | — | 10 mass parts | — | — | — | — | — | — | — |
| | Special Black 4 | 40 mass parts | — | 70 mass parts | 40 mass parts | 40 mass parts | 40 mass parts | 40 mass parts | — | 100 mass parts |
| Metal particles | Silver particles (SPH02J) | — | — | — | — | — | — | — | 30 mass parts | — |
| Graphitized particles A | | 60 mass parts | 90 mass parts | 30 mass parts | 60 mass parts | 60 mass parts | 60 mass parts | 60 mass parts | 90 mass parts | — |
| Spherical particles | ICB0520 | 30 mass parts | 30 mass parts | 30 mass parts | 10 mass parts | — | 5 mass parts | — | 30 mass parts | 30 mass parts |
| | ICB1020 | — | — | — | — | 25 mass parts | — | 30 mass parts | — | — |
| Work function value (eV) | | 4.8 | 4.6 | 4.9 | 4.8 | 4.8 | 4.8 | 4.8 | 4.5 | 5.0 |
| RaS (μm) | | 0.95 | 0.95 | 0.95 | 0.60 | 1.50 | 0.50 | 1.70 | 0.95 | 0.95 |

In the above Table, silver particles (SPH02J) are from Mitsui Mining & Smelting Co., Ltd. and spherical particles ICB1020 are Nicabeads ICB1020 (trade name) from Nippon Carbon Co., Ltd.

<Production Example of Magnetic Powder 1>

A ferrous sulfate aqueous solution was mixed with 1.0 or more and 1.1 or less iron-element equivalents of caustic soda solution, $P_2O_5$ at the amount of 0.15 mass % on the basis of phosphorus element relative to iron element and $SiO_2$ at the amount of 0.50 mass % on the basis of silicon element relative to iron element to prepare an aqueous solution containing ferrous hydroxide. The aqueous solution was adjusted to pH 8.0 and oxidation reaction was carried out at 85° C. while bubbling air to prepare a slurry containing seed crystals.

The slurry was added with a ferrous sulfate aqueous solution so as to be 0.9 or more and 1.2 or less equivalents relative to the initial amount of alkaline (sodium component of caustic soda), maintained at pH 7.6 and oxidation reaction was carried out while bubbling air to obtain a slurry containing magnetic iron oxide. The slurry was filtered, washed and dried before crashing the obtained particles to provide magnetic powder having the number-average particle diameter of 0.22 μm. Physical properties of the obtained magnetic powder 1 are shown in Table 2.

<Production Examples of Magnetic Powders 2 to 11>

Magnetic powders 2 to 11 were obtained by adjusting the amounts of $P_2O_5$ and $SiO_2$ in the production of the magnetic powder 1. Physical properties of the obtained magnetic powders are shown in Table 2.

TABLE 2

| | Number average particle diameter (μm) | σs ($Am^2/kg$) | σr ($Am^2/kg$) |
|---|---|---|---|
| Magnetic powder 1 | 0.22 | 84.8 | 4.2 |
| Magnetic powder 2 | 0.22 | 84.7 | 2.4 |
| Magnetic powder 3 | 0.21 | 84.7 | 7.3 |
| Magnetic powder 4 | 0.25 | 86.7 | 1.9 |
| Magnetic powder 5 | 0.25 | 86.7 | 5.8 |
| Magnetic powder 6 | 0.22 | 85.7 | 2.5 |
| Magnetic powder 7 | 0.27 | 88.6 | 1.9 |
| Magnetic powder 8 | 0.19 | 84.7 | 7.7 |
| Magnetic powder 9 | 0.20 | 85.7 | 7.6 |

TABLE 2-continued

| | Number average particle diameter (μm) | σs ($Am^2/kg$) | σr ($Am^2/kg$) |
|---|---|---|---|
| Magnetic powder 10 | 0.23 | 86.7 | 6.2 |
| Magnetic powder 11 | 0.26 | 88.6 | 5.8 |

<Production Example of Binder Resin 1>

To a four-neck flask were charged 300 mass parts of xylene and while heating and refluxing, a mixed solution of 80 mass parts of styrene, 20 mass parts of n-butyl acrylate and 2 mass parts of di-tert-butylperoxide was added dropwise over 5 hours to obtain a low molecular weight polymer (L-1) solution.

To another four-neck flask were charged 180 mass parts of degassed water and 20 mass parts of a 2 mass % aqueous solution of polyvinyl alcohol, followed by addition of a mixed solution of 75 mass parts of styrene, 25 mass parts of n-butyl acrylate, 0.005 mass parts of divinylbenzene and 0.1 mass parts of 2,2-bis(4,4-di-tert-butylperoxycyclohexyl)propane (10-hour half-life temperature: 92° C.) and stirring to obtain a suspension. After the interior of the flask was thoroughly replaced with nitrogen, the temperature was raised to 85° C. and polymerization was carried out; after holding for 24 hours, 0.1 mass parts of benzoyl peroxide (10-hour half-life temperature: 72° C.) was added and holding was continued for another 12 hours to finish the polymerization of a high molecular weight polymer (H-1).

To 300 mass parts of the homogeneous solution of the above low molecular weight polymer (L-1) was added 25 mass parts of the high molecular weight polymer (H-1) and mixed thoroughly under reflux followed by distillative removal of the organic solvent to yield a styrene-acrylic resin 1 (glass-transition temperature Tg: 60° C., acid value: 0 mgKOH/g).

<Production Example of Magnetic Toner Particles 1>

Styrene-acrylic resin 1: 100 mass parts

Wax: 5.0 mass parts (low molecular weight polyethylene, melting point: 102° C., number average molecular weight (Mn): 850)

Magnetic powder 1: 95 mass parts

Charge control agent T-77 (Hodogaya Chemical Co., Ltd.): 1.5 mass parts

The above starting materials were pre-mixed in a Henschel mixer FM10C (Mitsui Miike Kakoki K.K.) followed by kneading with a twin-screw kneader/extruder (PCM-30, Ikegai Ironworks Corporation) set at a rotation rate of 200 rpm with the set temperature being adjusted to provide a direct temperature in the vicinity of the outlet for the kneaded material of 150° C.

The resulting melt-kneaded material was cooled, the cooled melt-kneaded material was coarsely pulverized with a cutter mill, the resulting coarsely pulverized material was finely pulverized using a Turbo Mill T-250 (Turbo Kogyo Co., Ltd.) at a feed rate of 20 kg/hr with the air temperature adjusted to provide an exhaust gas temperature of 38° C., and classification was performed using a Coanda effect-based multifraction classifier to obtain magnetic toner particles 1 having a weight-average particle diameter (D4) of 8.5 μm. The production conditions and physical properties for magnetic toner particles 1 are shown in Table 3.

<Production Examples of Magnetic Toner Particles 2 to 16>

Magnetic toner particles 2 to 16 were obtained by appropriately adjusting the type and amount of magnetic powder, exhausting temperature of fine pulverization and classification conditions as shown in Table 3 in Production Example of magnetic toner 1. The production conditions and physical properties for magnetic toner particles 2 to 16 are shown in Table 3.

TABLE 3

| Magnetic toner particles | Magnetic powder | Content of magnetic powder (mass parts) | Exhausting temperature upon pulverization (° C.) | Average circularity | D4 (μm) | True density d (g/cm$^3$) |
|---|---|---|---|---|---|---|
| 1 | 1 | 95 | 38 | 0.943 | 8.5 | 1.68 |
| 2 | 1 | 95 | 25 | 0.936 | 8.4 | 1.68 |
| 3 | 1 | 95 | 38 | 0.954 | 8.6 | 1.69 |
| 4 | 2 | 75 | 45 | 0.954 | 8.8 | 1.56 |
| 5 | 3 | 75 | 45 | 0.953 | 8.9 | 1.55 |
| 6 | 4 | 115 | 45 | 0.954 | 7.5 | 1.92 |
| 7 | 5 | 100 | 45 | 0.953 | 7.6 | 1.72 |
| 8 | 5 | 115 | 45 | 0.952 | 7.7 | 1.92 |
| 9 | 6 | 70 | 45 | 0.953 | 9.0 | 1.53 |
| 10 | 7 | 115 | 45 | 0.954 | 7.8 | 1.91 |
| 11 | 8 | 75 | 45 | 0.953 | 8.7 | 1.56 |
| 12 | 9 | 70 | 45 | 0.952 | 8.9 | 1.53 |
| 13 | 10 | 115 | 45 | 0.953 | 4.6 | 1.91 |
| 14 | 11 | 115 | 45 | 0.954 | 7.8 | 1.92 |
| 15 | 6 | 70 | 50 | 0.956 | 8.7 | 1.52 |
| 16 | 6 | 70 | 20 | 0.934 | 8.8 | 1.53 |

<Production Example of magnetic toner 1>

The theoretical specific surface area B calculated for the magnetic toner particles 1 was 0.60 m$^2$/g. The magnetic toner particles 1, 100 mass parts, was mixed with 2.1 mass parts of silica fine powder [hydrophobic silica fine powder obtained by treating 100 mass parts of dry silica (BET specific surface area: 200 m$^2$/g, number-average particle diameter (D1) of primary particles: 12 nm) with 20 mass parts of hexamethyldisilazane and treating 100 mass parts of the treated silica with 10 mass parts of dimethyl silicone oil] and 1.0 mass part of strontium titanate having the number-average particle diameter of primary particles of 0.9 μm and charged in a Henschel mixer FM10C. In the Henschel mixer FM10C, external addition was carried out, under the condition of the blade rotating speed of 4000 rpm, for 5 minutes and the blade was stopped for 1 minute to drop the internal temperature followed by external addition of further 5 minutes. This procedure was repeated so as to carry out external addition 5 times for 5 minutes to obtain magnetic toner 1. Physical properties of the magnetic toner 1 are shown in Table 4.

<Production Examples of Magnetic Toners 2 to 25>

Magnetic toners 2 to 25 were obtained in the same manner as Production Example of the magnetic toner 1 except that magnetic toner particles shown in Table 4 were used and the W/B was adjusted by the theoretical specific surface area and the amount of silica fine powder. Physical properties of the magnetic toners 2 to 25 are shown in Table 4.

TABLE 4

| Magnetic toner | Magnetic toner particles | W/B | Average circularity | σs of magnetic toner (Am$^2$/kg) | σr of magnetic toner (Am$^2$/kg) | Amount of strontium titanate (mass parts) |
|---|---|---|---|---|---|---|
| 1 | 1 | 3.5 | 0.943 | 40.2 | 2.2 | 1.0 |
| 2 | 2 | 3.5 | 0.936 | 39.9 | 1.9 | 1.0 |
| 3 | 3 | 3.5 | 0.954 | 40.1 | 2.0 | 1.0 |
| 4 | 3 | 2.5 | 0.954 | 40.1 | 2.1 | 1.0 |
| 5 | 3 | 10.0 | 0.954 | 40.0 | 1.9 | 1.0 |
| 6 | 3 | 3.0 | 0.954 | 40.1 | 2.1 | 1.0 |
| 7 | 3 | 5.0 | 0.954 | 39.9 | 1.9 | 1.0 |
| 8 | 4 | 3.5 | 0.954 | 35.0 | 1.0 | 1.0 |
| 9 | 5 | 3.5 | 0.953 | 35.1 | 3.0 | 1.0 |
| 10 | 6 | 3.5 | 0.954 | 45.0 | 1.0 | 1.0 |
| 11 | 7 | 3.5 | 0.953 | 39.5 | 2.4 | 1.0 |
| 12 | 8 | 3.5 | 0.952 | 44.9 | 3.0 | 1.0 |
| 13 | 9 | 3.5 | 0.953 | 34.0 | 1.0 | 1.0 |
| 14 | 10 | 3.5 | 0.954 | 46.1 | 1.0 | 1.0 |
| 15 | 11 | 3.5 | 0.953 | 35.1 | 3.2 | 1.0 |
| 16 | 12 | 3.5 | 0.952 | 34.2 | 3.0 | 1.0 |
| 17 | 13 | 3.5 | 0.953 | 44.9 | 3.2 | 1.0 |
| 18 | 14 | 3.5 | 0.954 | 46.0 | 3.0 | 1.0 |
| 19 | 15 | 3.5 | 0.956 | 34.2 | 1.0 | 1.0 |
| 20 | 16 | 3.5 | 0.934 | 34.0 | 1.0 | 1.0 |
| 21 | 16 | 3.5 | 0.934 | 34.1 | 1.0 | 0.0 |
| 22 | 1 | 2.5 | 0.943 | 40.0 | 2.0 | 1.0 |
| 23 | 1 | 2.4 | 0.943 | 40.1 | 2.0 | 1.0 |
| 24 | 1 | 10.0 | 0.943 | 40.2 | 2.1 | 1.0 |
| 25 | 1 | 10.5 | 0.943 | 39.9 | 1.9 | 1.0 |

Example 1

Evaluation 1

Durability Test Density in High-Temperature, High-Humidity Environment and Reduction in Density after Standing An evaluation apparatus was a laser beam printer: Laser Jet 2055dn from Hewlett-Packard Company modified to have process speed of 310 mm/sec.

A process cartridge was modified so as to double the capacity and contain the magnetic toner-carrying member 1 as the magnetic toner-carrying member.

The toner regulating member used was the one containing a support member of a phosphor bronze plate having a thickness of 100 μm onto which a blade material of a polyphenylene sulfide film (Torelina film type 3000, Toray Industries, Inc.) having a thickness of 100 μm was bonded. The surface of the polyphenylene sulfide was subjected to taper grinding and the surface roughness (RaB) at the portion contacting the magnetic toner-carrying member was 0.48 μm.

The toner regulating member 12 is fixed in a developer container such that, as shown in FIG. 3, one free end of the toner regulating member 12 is sandwiched with two metal elastic bodies 13 and fixed with screws in order to prevent corrugating in the longitudinal direction. The other free end of the toner regulating member 12 contacts at the end thereof the surface of the magnetic toner-carrying member 3 at predetermined pressure, so that the shape thereof is changed by elasticity. The toner regulating member 12 regulates the thickness of a layer of magnetic toner 14 attracted to the surface of the magnetic toner-carrying member Table by means of magnetism of the magnet 16. In the present Example, pressure applied to the magnetic toner-carrying member 3 by the toner regulating member 12 was 10 N/m and the distance between the position where the toner regulating member contacts the magnetic toner-carrying member and the free end was 2 mm. The magnetic toner 1 was charged in the modified process cartridge.

The evaluation apparatus containing the modified cartridge was left to stand overnight in the high-temperature, high-humidity environment of 32.5° C. and 80% RH.

Using this as the image printing test apparatus, a 20000-print durability test was performed in one-sheet intermittent mode of horizontal lines at a coverage rate of 1% with A4 plain paper (75 g/m$^2$). Reduction in density and fogging after standing can be more severely evaluated by using the magnetic toner-carrying member having relatively small diameter and using the above modes.

After measuring image density of a solid image following 20000 prints, the apparatus was left to stand in the same environment for 5 days followed by printing of a solid image for measurement of image density.

The image density was measured with a "MacBeth reflection densitometer" (MacBeth Corporation) as relative density to a white zone in a printout image having the density of 0.00.

Image density of a solid image after 20000-sheet printing ("Evaluation 1: density after durability test" in Table 6) and image density of a solid image after further 5-day standing ("Evaluation 1: density reduction after standing" in Table 6) were evaluated according to the following criteria. The results are shown in Table 6.

Evaluation criteria of image density of a solid image after 20000 prints are as follows.

A: 1.40 or more
B: 1.35 or more and less than 1.40
C: 1.30 or more and less than 1.35
D: Less than 1.30

Evaluation criteria of image density of a solid image after 5-day standing are as follows.

A: Density reduction of less than 0.05 relative to the density before 5-day standing
B: Density reduction of 0.05 or more and less than 0.10 relative to the density before 5-day standing
C: Density reduction of 0.10 or more and less than 0.15 relative to the density before 5-day standing
D: Density reduction of 0.15 or more relative to the density before 5-day standing Evaluation 2

Fogging after Standing in High-Temperature, High-Humidity Environment

After Evaluation 1, the evaluation apparatus and modified process cartridge were left to stand in the same environment for further 3 days.

After standing, a solid white image was printed out for evaluation of fogging. Fogging (%) was calculated from the comparison between white chromaticity of a transfer paper and that of a transfer paper after printing the white solid image measured with a refractometer (Tokyo Denshoku Co., Ltd.).

Evaluation criteria of fogging are as follows.

A: Maximum fogging in a paper is less than 1.0%
B: Maximum fogging in a paper is 1.0% or more and less than 1.5%
C: Maximum fogging in a paper is 1.5% or more and less than 2.5%
D: Maximum fogging in a paper is 2.5% or more Evaluation 3

Image Density Non-Uniformity/Streaks Due to Toner Melt Adhesion

In Evaluation 1 after 20000 prints, a halftone image was printed out as well and image density non-uniformity and streaks due to toner melt adhesion were evaluated. Halftone images allow severer evaluation of image density non-uniformity and streaks than solid images.

Evaluation criteria of image density non-uniformity and streaks are as follows.

A: No image density non-uniformity or streaks
B: Slight image density non-uniformity and streaks are observed in a halftone image, but none in a solid image
C: Slight image density non-uniformity is observed but significant streaks are not observed even in a solid image
D: Significant image density non-uniformity and streaks are observed in a solid image Examples 2 to 43 and Comparative Examples 1 to 11

Evaluations were performed in the same manner as Example 1 with the configurations shown in Table 5. The results are shown in Table 6.

TABLE 5

| | Toner | Toner regulating member | Toner-carrying member | RaS (μm) | Work function value (eV) | RaS/RaB |
|---|---|---|---|---|---|---|
| Ex. 1 | 1 | PPS | 1 | 0.95 | 4.8 | 2.0 |
| Ex. 2 | 1 | Olefin | 1 | 0.95 | 4.8 | 2.0 |
| Ex. 3 | 2 | PPS | 1 | 0.95 | 4.8 | 2.0 |
| Ex. 4 | 3 | PPS | 1 | 0.95 | 4.8 | 2.0 |
| Ex. 5 | 4 | PPS | 2 | 0.95 | 4.6 | 2.0 |
| Ex. 6 | 5 | PPS | 2 | 0.95 | 4.6 | 2.0 |
| Ex. 7 | 4 | PPS | 3 | 0.95 | 4.9 | 2.0 |
| Ex. 8 | 5 | PPS | 3 | 0.95 | 4.9 | 2.0 |
| Ex. 9 | 3 | Olefin | 1 | 0.95 | 4.8 | 2.0 |
| Ex. 10 | 4 | Olefin | 2 | 0.95 | 4.6 | 2.0 |
| Ex. 11 | 6 | Olefin | 2 | 0.95 | 4.6 | 2.0 |
| Ex. 12 | 7 | Olefin | 2 | 0.95 | 4.6 | 2.0 |
| Ex. 13 | 5 | Olefin | 2 | 0.95 | 4.6 | 2.0 |
| Ex. 14 | 4 | Olefin | 3 | 0.95 | 4.9 | 2.0 |
| Ex. 15 | 6 | Olefin | 3 | 0.95 | 4.9 | 2.0 |
| Ex. 16 | 7 | Olefin | 3 | 0.95 | 4.9 | 2.0 |
| Ex. 17 | 5 | Olefin | 3 | 0.95 | 4.9 | 2.0 |
| Ex. 18 | 8 | PPS | 1 | 0.95 | 4.8 | 2.0 |
| Ex. 19 | 9 | PPS | 1 | 0.95 | 4.8 | 2.0 |
| Ex. 20 | 10 | PPS | 1 | 0.95 | 4.8 | 2.0 |
| Ex. 21 | 11 | PPS | 1 | 0.95 | 4.8 | 2.0 |
| Ex. 22 | 12 | PPS | 1 | 0.95 | 4.8 | 2.0 |
| Ex. 23 | 13 | PPS | 1 | 0.95 | 4.8 | 2.0 |
| Ex. 24 | 14 | PPS | 1 | 0.95 | 4.8 | 2.0 |
| Ex. 25 | 15 | PPS | 1 | 0.95 | 4.8 | 2.0 |
| Ex. 26 | 16 | PPS | 1 | 0.95 | 4.8 | 2.0 |
| Ex. 27 | 17 | PPS | 1 | 0.95 | 4.8 | 2.0 |
| Ex. 28 | 18 | PPS | 1 | 0.95 | 4.8 | 2.0 |
| Ex. 29 | 19 | PPS | 1 | 0.95 | 4.8 | 2.0 |
| Ex. 30 | 20 | PPS | 1 | 0.95 | 4.8 | 2.0 |

TABLE 5-continued

| | Toner | Toner regulating member | Toner-carrying member | RaS (μm) | Work function value (eV) | RaS/RaB |
|---|---|---|---|---|---|---|
| Ex. 31 | 21 | PPS | 1 | 0.95 | 4.8 | 2.0 |
| Ex. 32 | 21 | PPS | 4 | 0.60 | 4.8 | 1.0 |
| Ex. 33 | 21 | PPS | 4 | 0.60 | 4.8 | 3.0 |
| Ex. 34 | 21 | PPS | 5 | 1.50 | 4.8 | 1.0 |
| Ex. 35 | 21 | PPS | 5 | 1.50 | 4.8 | 3.0 |
| Ex. 36 | 21 | PPS | 4 | 0.60 | 4.8 | 0.8 |
| Ex. 37 | 21 | PPS | 6 | 0.50 | 4.8 | 1.0 |
| Ex. 38 | 21 | PPS | 4 | 0.60 | 4.8 | 3.2 |
| Ex. 39 | 21 | PPS | 6 | 0.50 | 4.8 | 3.0 |
| Ex. 40 | 21 | PPS | 5 | 1.50 | 4.8 | 0.8 |
| Ex. 41 | 21 | PPS | 7 | 1.70 | 4.8 | 1.0 |
| Ex. 42 | 21 | PPS | 5 | 1.50 | 4.8 | 3.2 |
| Ex. 43 | 21 | PPS | 7 | 1.70 | 4.8 | 3.0 |
| Comp. Ex. 1 | 1 | Silicone | 1 | 0.95 | 4.8 | 2.0 |
| Comp. Ex. 2 | 1 | PC | 1 | 0.95 | 4.8 | 2.0 |
| Comp. Ex. 3 | 1 | PET | 1 | 0.95 | 4.8 | 2.0 |
| Comp. Ex. 4 | 22 | PPS | 8 | 0.95 | 4.5 | 2.0 |
| Comp. Ex. 5 | 23 | PPS | 2 | 0.95 | 4.6 | 2.0 |
| Comp. Ex. 6 | 22 | PPS | 9 | 0.95 | 5.0 | 2.0 |
| Comp. Ex. 7 | 23 | PPS | 3 | 0.95 | 4.9 | 2.0 |
| Comp. Ex. 8 | 24 | PPS | 8 | 0.95 | 4.5 | 2.0 |
| Comp. Ex. 9 | 25 | PPS | 2 | 0.95 | 4.6 | 2.0 |
| Comp. Ex. 10 | 24 | PPS | 9 | 0.95 | 5.0 | 2.0 |
| Comp. Ex. 11 | 25 | PPS | 3 | 0.95 | 4.9 | 2.0 |

In the above Table, PPS represents the above polyphenylene sulfide film, PC represents a polycarbonate sheet (Panlite sheet PC-2151: Teijin Chemicals Ltd.), PET represents a polyethylene terephthalata film (Teijin Tetoron film G2: Teijin DuPont Films Japan Limited) and silicone represents a silicon rubber sheet (SC50NNS: Kureha Elastomer Co., Ltd.). As olefin, a polypropylene film (Novatec PP FW4BT: Japan Polypropylene Corporation) was used. The regulating members used were, as Example 1, the ones obtained by bonding PC, PET, olefin or silicone on the surface of a phosphor bronze plate having a thickness of 100 μm and subjected to taper grinding.

TABLE 6

| | Evaluation 1: Density after durability test | Evaluation 1: Density reduction after standing | Evaluation 2: Fogging after standing | Evaluation 3: Image density non-uniformity/streaks |
|---|---|---|---|---|
| Ex. 1 | A (1.45) | A (0.02) | A (0.3) | A |
| Ex. 2 | A (1.45) | A (0.02) | A (0.4) | A |
| Ex. 3 | A (1.43) | A (0.03) | A (0.4) | A |
| Ex. 4 | A (1.44) | A (0.02) | A (0.4) | A |
| Ex. 5 | A (1.44) | A (0.02) | A (0.8) | A |
| Ex. 6 | A (1.44) | A (0.04) | A (0.4) | A |
| Ex. 7 | A (1.40) | A (0.03) | A (0.3) | A |
| Ex. 8 | A (1.43) | A (0.03) | A (0.4) | A |
| Ex. 9 | A (1.44) | A (0.02) | A (0.4) | A |
| Ex. 10 | A (1.44) | A (0.02) | A (0.9) | A |
| Ex. 11 | A (1.44) | A (0.02) | A (0.9) | A |
| Ex. 12 | A (1.44) | A (0.03) | A (0.7) | A |
| Ex. 13 | A (1.43) | A (0.04) | A (0.4) | A |
| Ex. 14 | A (1.41) | A (0.03) | A (0.4) | A |
| Ex. 15 | A (1.41) | A (0.03) | A (0.4) | A |
| Ex. 16 | A (1.41) | A (0.03) | A (0.4) | A |
| Ex. 17 | A (1.40) | A (0.04) | A (0.5) | A |
| Ex. 18 | A (1.43) | A (0.03) | B (1.1) | A |
| Ex. 19 | A (1.43) | A (0.03) | A (0.6) | A |
| Ex. 20 | A (1.42) | A (0.03) | A (0.6) | A |
| Ex. 21 | B (1.39) | B (0.05) | A (0.3) | A |
| Ex. 22 | B (1.39) | B (0.05) | A (0.4) | A |
| Ex. 23 | A (1.43) | A (0.03) | B (1.3) | B |
| Ex. 24 | B (1.39) | B (0.05) | A (0.6) | B |

TABLE 6-continued

| | Evaluation 1: Density after durability test | Evaluation 1: Density reduction after standing | Evaluation 2: Fogging after standing | Evaluation 3: Image density non-uniformity/streaks |
|---|---|---|---|---|
| Ex. 25 | A (1.43) | A (0.03) | C (1.5) | B |
| Ex. 26 | A (1.42) | A (0.03) | B (1.1) | B |
| Ex. 27 | B (1.36) | C (0.10) | A (0.7) | B |
| Ex. 28 | B (1.36) | B (0.09) | A (0.6) | B |
| Ex. 29 | A (1.42) | A (0.04) | B (1.4) | B |
| Ex. 30 | B (1.39) | A (0.03) | B (1.4) | B |
| Ex. 31 | B (1.38) | A (0.04) | B (1.4) | B |
| Ex. 32 | B (1.36) | B (0.08) | B (1.3) | B |
| Ex. 33 | B (1.38) | B (0.05) | B (1.4) | B |
| Ex. 34 | B (1.38) | B (0.06) | B (1.3) | B |
| Ex. 35 | B (1.35) | B (0.09) | B (1.4) | B |
| Ex. 36 | B (1.36) | B (0.09) | B (1.4) | C |
| Ex. 37 | C (1.34) | B (0.08) | B (1.4) | C |
| Ex. 38 | B (1.37) | B (0.09) | B (1.3) | C |
| Ex. 39 | C (1.34) | B (0.08) | B (1.4) | B |
| Ex. 40 | B (1.35) | B (0.09) | B (1.3) | C |
| Ex. 41 | B (1.36) | C (0.11) | B (1.4) | C |
| Ex. 42 | B (1.35) | B (0.09) | C (1.8) | C |
| Ex. 43 | B (1.35) | C (0.12) | C (1.9) | C |
| Comp. Ex. 1 | C (1.32) | D (0.21) | D (2.6) | D |
| Comp. Ex. 2 | C (1.31) | D (0.20) | D (2.7) | D |
| Comp. Ex. 3 | C (1.32) | D (0.22) | D (2.6) | D |
| Comp. Ex. 4 | C (1.34) | D (0.16) | D (2.7) | C |
| Comp. Ex. 5 | C (1.34) | D (0.17) | D (2.6) | D |
| Comp. Ex. 6 | D (1.29) | D (0.16) | C (2.0) | C |
| Comp. Ex. 7 | D (1.29) | D (0.18) | D (2.7) | D |
| Comp. Ex. 8 | C (1.33) | D (0.17) | D (2.6) | C |
| Comp. Ex. 9 | C (1.34) | D (0.16) | D (2.8) | D |
| Comp. Ex. 10 | D (1.29) | D (0.17) | C (2.1) | C |
| Comp. Ex. 11 | D (1.28) | D (0.18) | D (2.6) | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-286203, filed Dec. 27, 2011, which is hereby incorporated by reference herein in its entirety.

What is claimed is:

1. A developing apparatus comprising an electrostatic latent image bearing member on which an electrostatic latent image is formed, magnetic toner for developing the electrostatic latent image, a magnetic toner-carrying member arranged so as to oppose the electrostatic latent image bearing member for carrying and transporting the magnetic toner, and a toner regulating member contacting the magnetic toner-carrying member and regulating the magnetic toner carried on the magnetic toner-carrying member, wherein:

the magnetic toner-carrying member has a work function value at the surface of 4.6 eV or more and 4.9 eV or less, a portion of the toner regulating member, which is contacting the magnetic toner, is made of a polyphenylene sulfide or a polyolefin, and the magnetic toner i) comprises magnetic toner particles, each of which contains a binder resin and magnetic powder, and silica fine powder, ii) has negative charging property, iii) has a ratio [W/B] of an amount W (mass % relative to the magnetic toner) of the silica fine powder to a theoretical specific surface area B ($m^2/g$) of the magnetic toner determined from particle diameter distribution (number statistical value) satisfying the following formula (1):

$$2.5 \leq W/B \leq 10.0. \quad (1)$$

2. The developing apparatus according to claim 1, wherein the magnetic toner-carrying member has a surface roughness (RaS) of 0.60 μm or more and 1.50 μm or less, and a ratio [RaS/RaB] of the surface roughness (RaS) of the magnetic toner-carrying member to a surface roughness (RaB) of the portion, of the toner regulating member, which contacts the magnetic toner is 1.0 or more and 3.0 or less.

3. The developing apparatus according to claim 1, wherein the magnetic toner further comprises strontium titanate fine powder.

4. The developing apparatus according to claim 1, wherein the magnetic toner has a saturation magnetization σs of 35 $Am^2/kg$ or more and 45 $Am^2/kg$ or less at a measurement magnetic field of 795.8 kA/m, and a residual magnetization σr of 3.0 $Am^2/kg$ or less at a measurement magnetic field of 795.8 kA/m.

5. A method for developing an electrostatic latent image formed on an electrostatic latent image bearing member using magnetic toner that is carried on a magnetic toner-carrying member arranged so as to oppose the electrostatic latent image bearing member and that is regulated by a toner regulating member contacting the magnetic toner-carrying member, wherein:

the magnetic toner-carrying member has a work function value at the surface of 4.6 eV or more and 4.9 eV or less, a portion of the toner regulating member, which is contacting the magnetic toner, is made of a polyphenylene sulfide or a polyolefin, and the magnetic toner i) comprises magnetic toner particles, each of which contains a binder resin and magnetic powder, and silica fine powder, ii) has negative charging property, iii) has a ratio [W/B] of an amount W (mass % relative to the magnetic toner) of the silica fine powder to a theoretical specific surface area B ($m^2/g$) of the magnetic toner determined from particle diameter distribution (number statistical value) satisfying the following formula (1):

$$2.5 \leq W/B \leq 10.0. \quad (1)$$

* * * * *